US006885841B2

(12) United States Patent
Harada et al.

(10) Patent No.: US 6,885,841 B2
(45) Date of Patent: Apr. 26, 2005

(54) IMAGE FORMING APPARATUS AND COLOR SUPERIMPOSITION ADJUSTMENT METHOD OF IMAGE FORMING APPARATUS

(75) Inventors: Yoshikazu Harada, Nara (JP); Kyosuke Taka, Nara (JP); Norio Tomita, Yamatokooriyama (JP); Nobuo Manabe, Yamatokooriyama (JP); Toshio Yamanaka, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 50 days.

(21) Appl. No.: 10/660,035

(22) Filed: Sep. 10, 2003

(65) Prior Publication Data

US 2004/0052554 A1 Mar. 18, 2004

(30) Foreign Application Priority Data

Sep. 17, 2002 (JP) ..... 2002-270739

(51) Int. Cl.[7] ..... G03G 15/01
(52) U.S. Cl. ..... 399/301; 399/231
(58) Field of Search ..... 399/223, 231, 399/297, 298, 299, 301

(56) References Cited

U.S. PATENT DOCUMENTS 6,148,168 A * 11/2000 Hirai et al. ..... 399/301
6,188,861 B1 * 2/2001 Parker et al. ..... 399/299
6,334,039 B1 * 12/2001 Yoshinaga et al. ..... 399/298

FOREIGN PATENT DOCUMENTS

JP 10-213940 8/1998
JP 2000-081744 3/2000

* cited by examiner

*Primary Examiner*—Hoan Tran
(74) *Attorney, Agent, or Firm*—David G. Conlin; David A. Tucker; Edwards & Angell, LLP

(57) ABSTRACT

Each of a plurality of combined images is formed separately for each image carrier with respect to a length related to the circumference length (Dp×π) of the image carrier. There is provided a combined-image adjusting section for forming a combined image so that a density detecting section detects the density of the combined image at plural and substantially equal pitches within a range of at least one circumference length (Dp×π) of the image carrier, or so that the density detecting section detects the density average value of the combined image at plural and substantially equal pitches within a range of at least one circumference length (Dp×π) of the image carrier.

22 Claims, 18 Drawing Sheets

IMAGE FORMING APPARATUS AND COLOR SUPERIMPOSITION ADJUSTMENT METHOD OF IMAGE FORMING APPARATUS

BACKGROUND OF THE INVENTION

The present invention relates to an electrophotographic type image forming apparatus and a color superimposition adjustment method of an image forming apparatus, and more specifically relates to an image forming apparatus capable of automatically correcting color misregistration of a multi-color image which is caused when forming the multi-color image by superimposing color component images formed on image carriers or a transfer carrier, and also relates to a color superimposition adjustment method of an image forming apparatus, for automatically correcting color misregistration of a multi-color image.

In a conventional image forming apparatus such as a digital color copying machine, inputted image data is decomposed into respective color components to perform image processing, and then the respective color component images are superimposed to form a multi-color image. In such an image forming apparatus, however, when the respective color component images are not accurately superimposed, color misregistration occurs in a multi-color image to be formed. Consequently, there is a possibility of a decrease in the image quality.

Besides, conventionally, there is known a tandem type image forming apparatus which comprises one image forming section for each color component so as to improve the formation speed of a multi-color image. In this tandem type image forming apparatus, respective color component images are formed in respective image forming sections, and then the respective color component images are superimposed sequentially to form a multi-color image. In such an image forming apparatus, since the rotation behaviors of the photosensitive bodies of the respective image forming sections differ from each other, there tend to be differences in the transfer positions of the respective color component images. Thus, color misregistration of a multi-color image is a serious problem for tandem type image forming apparatuses.

In order to accurately superimpose the respective color component images, an image forming apparatus performs a color superimposition adjustment for correcting color misregistration of a multi-color image, and thereby forming a satisfactory multi-color image without color misregistration. This color superimposition adjustment is usually carried out by using an optical detector to detect a displacement of the image forming position of other color component with respect to the image forming position of a reference color component. Based on the detection result of the detector, a correction amount for the displacement is determined. Moreover, according to this correction amount, timings of forming respective color component images are adjusted so that the transfer positions of the respective color component images coincide with each other. In general, this correction amount is determined by transferring the respective color component images at the same timing and detecting the distance between the transfer positions of the respective color components, or by measuring the density of the multi-color image formed by superimposing the respective color components.

For example, in an image forming apparatus disclosed in Japanese Patent Application Laid-Open No. 10-213940 (1998), the distance between the transfer positions of the respective color component images is detected, and a correction is made based on the detected amount of displacement of the transfer position. Specifically, by detecting the distance between an image formed by a reference color component and an image formed by other color component with a detector and then determining the amount of displacement of the transfer position of the respective color component images based on the detected distance, color misregistration of the multi-color image is corrected.

Further, Japanese Patent Application Laid-Open No. 2000-81744 discloses an image forming apparatus which corrects color misregistration by measuring the density of a multi-color image formed by superimposing respective color component images. More specifically, the correction of color misregistration is made so that the measured density of the multi-color image is equal to a density which is obtained when the respective color component images are accurately superimposed.

Moreover, this image forming apparatus of Japanese Application Laid-Open No. 2000-81744 repeatedly forms a plurality of same images for each color component image so as to improve the accuracy of correcting color misregistration. Specifically, according to this application, a plurality of line images are formed as the same images for each color component, and the densities of multi-color line images are detected with a detector to find the superimposed state of the respective color component line images. Then, a state in which the density of a multi-color line image detected with the detector is within a predetermined density range is considered as a state in which the respective color component line images are accurately superimposed, and a correction is made so that image formation is performed in this superimposed state, thereby correcting color misregistration of the multi-color image.

However, in the image forming apparatus of Japanese Patent Application Laid-Open No. 10-213940 (1998), since the displacement of the transfer position of the respective images is found using the detector for detecting the transfer positions of the respective color component images, there is a problem that a detector with high detection accuracy needs to be used to detect a minute displacement of the transfer position. Moreover, there is a problem that an accurate correction amount for color misregistration can not be determined due to the influence of irregularity in image formation caused by the rotational irregularity of an image carrier for forming an image to be detected, or by the rotational irregularity of a transfer carrier driving roller for driving a transfer carrier.

On the other hand, in the image forming apparatus disclosed in Japanese Patent Application Laid-Open No. 2000-81744, since the values of densities detected at a plurality of positions by performing sampling in a fixed cycle are averaged, this apparatus is relatively less susceptible to the influence of irregularity in image formation caused by the rotational irregularity of the image carrier, or the rotational irregularity of the transfer carrier driving roller for driving the transfer carrier.

However, depending on some image forming method or detection method, this image forming apparatus suffers from a problem that an accurate correction amount for color misregistration can not be determined due to the influence of irregularity in image formation. More specifically, suppose that an image formed by superimposing respective color component line images is a combined image. If the formation region of this combined image in a sub-scanning direction is short and one color component line image is formed in a region where the rotational velocity is higher or a region where the rotational velocity is lower, an accurate correction amount for color misregistration can not be determined. Moreover, if the sampling cycle is long and the number of samples is small, an accurate correction amount for color misregistration can not be determined.

BRIEF SUMMARY OF THE INVENTION

The present invention has been made with the aim of solving the above-mentioned conventional problems, and it is an object of the present invention to provide an image forming apparatus and a color superimposition adjustment method of an image forming apparatus, capable of performing color superimposition adjustment with high accuracy, without being influenced by irregularity in image formation caused by the rotational irregularity of an image carrier for forming an image, or by the rotational irregularity of a transfer carrier driving roller for driving a transfer carrier.

An image forming apparatus according to the first aspect of the present invention is an image forming apparatus comprising: a plurality of image carriers on which images are formed based on image data; a transfer carrier on which different color component images formed on the respective image carriers are superimposed sequentially with a movement of the transfer carrier in a sub-scanning direction; position changing means for changing a superimposing position of the different color component images; density detecting means for detecting a density average value of each combined image formed by superimposing the different color component images, for a plurality of combined images formed by superimposing the different color component images at respectively different positions; and position determining means for determining a superimposing position of the different color component images, based on detection results of the density detecting means, and characterized in that each of the plurality of combined images is formed separately for each image carrier with respect to a length related to a circumference length of the image carrier, and the image forming apparatus comprises combined-image adjusting means for forming a combined image so that the density detecting means detects a density of the combined image at plural and substantially equal pitches within a range of at least one circumference length of the image carrier, or so that the density detecting means detects a density average value of the combined image at plural and substantially equal pitches within a range of at least one circumference length of the image carrier.

According to the first aspect, first, for a plurality of combined images formed by superimposing the different color component images at respectively different positions, each combined image is formed separately with respect to a length related to the length circumference of the image carrier. Specifically, after at least substantially one rotation of each image carrier, a combined image with a changed superimposing position is formed.

Moreover, with the combined-image adjusting means, the density detecting means can detect the density of the combined image at plural and substantially equal pitches within a range of at least one circumference length of the image carrier. Or, with the combined-image adjusting means, the density detecting means can detect the density average value of the combined image at plural and substantially equal pitches within a range of at least one circumference length of the image carrier.

Here, with a rotation of the image carrier, a transfer of a toner image to the transfer carrier from the image carrier will be made. However, it is not always the case that the rotation of the image carrier is uniform. For example, there is a case where rotational irregularity is caused by the eccentricity of the image carrier. When there is such rotational irregularity, the relative velocity between the peripheral velocity of the image carrier and the moving velocity of the transfer carrier varies at the contact portion where the image carrier and the transfer carrier come into contact with each other.

Therefore, for a plurality of combined images formed by superimposing different color component images at respectively different positions, even when the density average values of the respective combined images are compared, if the regions of the image carriers where the respective color component images are formed differ randomly among the combined images, accurate comparison can not be made. Besides, when there is rotational irregularity caused by the eccentricity of the image carrier, the peripheral velocity of the image carrier changes in the cycle of one rotation of the image carrier.

Hence, under the condition of forming a combined image with a changed superimposing position after at least substantially one rotation of each image carrier, by detecting the density of the combined image at plural and substantially equal pitches within a range of the circumference length of the image carrier, even when there is rotational irregularity in each image carrier, sampling is performed so that the rotational irregularity can be cancelled, instead of uneven sampling. It is therefore possible to obtain a detection result similar to the value obtained when there is no rotational irregularity. Moreover, under the condition of forming a combined image with a changed superimposing position after at least substantially one rotation of each image carrier, by detecting the density average value of the combined image at plural and substantially equal pitches within a range of the circumference length of the image carrier, sampling is performed so that the rotational irregularity can be cancelled, instead of uneven sampling. It is therefore possible to obtain a detection result similar to the value obtained when there is no rotational irregularity.

Thus, for a plurality of combined images formed by superimposing different color components images at respectively different positions, it is possible to accurately compare the density average values of the respective combined images. Accordingly, highly accurate color superimposition adjustment can be performed without being influenced by the rotational irregularity of the image carrier.

An image forming apparatus according to the second aspect is an image forming apparatus comprising: a plurality of image carriers on which images are formed based on image data; a transfer carrier on which different color component images formed on the respective image carriers are superimposed sequentially with a movement of the transfer carrier in a sub-scanning direction; transfer carrier driving means for driving and rotating the transfer carrier; position changing means for changing a superimposing position of the different color component images; density detecting means for detecting a density average value of each combined image formed by superimposing the different color component images, for a plurality of combined images formed by superimposing the different color component images at respectively different positions; and position determining means for determining a superimposing position of the different color component images, based on detection results of the density detecting means, and characterized in that each of the plurality of combined images is formed separately with respect to a length related to a circumference length of the transfer carrier driving means, and the image forming apparatus comprises combined-image adjusting means for forming a combined image so that the density detecting means detects a density of the combined image at plural and substantially equal pitches within a range of at least one circumference length of the transfer carrier driving means, or so that the density detecting means detects a density average value of the combined image at plural and substantially equal pitches within a range of at least one circumference length of the transfer carrier driving means.

According to the second aspect, first, for a plurality of combined images formed by superimposing the different color component images at respectively different positions, each combined image is formed separately with respect to a length related to the circumference length of the transfer carrier driving means. Specifically, after at least substantially one rotation of the transfer carrier driving means, a combined image with a changed superimposing position is formed.

Moreover, with the combined-image adjusting means, the density detecting means can detect the density of the combined image at plural and substantially equal pitches within a range of the circumference length of the transfer carrier driving means. Or, with the combined-image adjusting means, the density detecting means can detect the density average value of the combined image at plural and substantially equal pitches within a range of the circumference length of the transfer carrier driving means.

Here, with a rotation of the transfer carrier driving means, a transfer of a toner image to the transfer carrier will be made. However, it is not always the case that the rotation of the transfer carrier driving means is uniform. For example, there is a case where rotational irregularity is caused by the eccentricity of the transfer carrier driving means. When there is such rotational irregularity, the moving velocity of the transfer carrier changes in a constant cycle corresponding to the rotational irregularity, and the relative velocity between the peripheral velocity of the image carrier and the moving velocity of the transfer carrier varies at the contact portion where the image carrier and the transfer carrier come into contact with each other.

Therefore, for a plurality of combined images formed by superimposing different color component images at respectively different positions, even when the density average values of the respective combined images are compared, if the change in the moving velocity of the transfer carrier driving means at the contact portion differs randomly in each combined image formation, accurate comparison can not be made. Besides, when there is rotational irregularity caused by the eccentricity of the transfer carrier driving means, the peripheral velocity of the transfer carrier driving means changes in the cycle of one rotation of the transfer carrier driving means.

Hence, under the condition of forming a combined image with a changed superimposing position after at least substantially one rotation of the transfer carrier driving means, by detecting the density of the combined image at plural and substantially equal pitches within the range of the circumference length of the transfer carrier driving means, even when there is rotational irregularity in the transfer carrier driving means, sampling is performed so that the rotational irregularity can be cancelled, instead of uneven sampling. It is therefore possible to obtain a detection result similar to the value obtained when there is no rotational irregularity. Moreover, under the condition of forming a combined image with a changed superimposing position after at least substantially one rotation of the transfer carrier driving means, by detecting the density average value of the combined image at plural and substantially equal pitches within the range of the circumference length of the transfer carrier driving means, sampling is performed so that the rotational irregularity can be cancelled, instead of uneven sampling. It is therefore possible to obtain a detection result similar to the value obtained when there is no rotational irregularity.

Hence, for a plurality of combined images formed by superimposing different color components images at respectively different positions, it is possible to accurately compare the density average values of the respective combined images. Accordingly, highly accurate color superimposition adjustment can be performed without being influenced by the rotational irregularity of the transfer carrier driving means.

In the first aspect or the second aspect, with the combined-image adjusting means, the length in sub-scanning direction of the combined image is adjusted to a length substantially s times the circumference length of the image carrier or the transfer carrier driving means.

Here, for example, a combined image is formed by defining that the value of s is a natural value. In this case, it is possible to detect the density average value of the combined image over a length of a natural number multiple of the circumference length of the image carrier or the transfer carrier driving means. Hence, even when there is rotational irregularity in the image carrier or the transfer carrier driving means, sampling is performed so that the rotational irregularity can be cancelled, instead of uneven sampling. It is therefore possible to obtain a detection result similar to the value obtained when there is no rotational irregularity. Thus, for a plurality of combined images formed by superimposing different color component images at respectively different positions, it is possible to accurately compare the density average values of the respective combined images.

Moreover, for example, a combined image is formed by defining that the value of s is a decimal number not less than 0 but less than 0.5. In this case, in a range of at least one circumference length of the image carrier or the transfer carrier driving means, it is possible to form a plurality of combined images, which are images formed by superimposing different color component images at the same position and arranged at mutually equal pitches. It is therefore possible to detect the density average value of the combined image at plural and substantially equal pitches within a range of at least one circumference length of the image carrier or the transfer carrier driving means.

Furthermore, for example, a combined image is formed by defining that the value of s is a decimal number not less than 0.5 but less than 1. In this case, by suitably setting the detection range of the density detecting means within a combined image formation range, it is possible to detect the density average values of combined images, which are images formed by superimposing different color component images at the same position and arranged at mutually equal pitches. In this case, it is therefore possible to detect the density average value of the combined image at plural and substantially equal pitches within a range of at least one circumference length of the image carrier or the transfer carrier driving means.

In addition, for example, a combined image is formed by defining that the value of s is an arbitrary value not less than 1. In this case, it is possible to detect at least the density of the combined image at plural and substantially equal pitches within a range of at least one circumference length of the image carrier or the transfer carrier driving means.

Hence, the value of s can be an arbitrary positive value. Accordingly, highly accurate color superimposition adjustment can be performed without being influenced by the rotational irregularity of the image carrier or the transfer carrier driving means.

The above-mentioned length substantially s times the circumference length of the image carrier or the transfer carrier driving means is a length calculated by adding a sub-scanning direction length of the detection surface of the density detecting means to a length s times the circumference length of the image carrier or the transfer carrier driving means.

Here, since the measurement range (namely, the measured region during sampling) when the detection surface of the density detecting means is used is usually a circular or oval shape, reflected light from a portion located at the center of the measurement range of the density detecting means and reflected light from a portion located at the edge of the measurement range differ from each other in the quantity of reflected light.

Therefore, by adding the sub-scanning direction length of the detection surface that is the detection region length of the density detecting means to a length s times the circumference length of the image carrier or the transfer carrier driving means, the combined image of a length s times the circumference length of the image carrier or the transfer carrier driving means can be detected at the center of the density detecting means. Accordingly, further accurate color superimposition adjustment can be performed.

When s is a positive integer, as described above, even when there is rotational irregularity in each image carrier or the transfer carrier driving means, it is possible to obtain a density average value similar to the value obtained when there is no rotational irregularity. Therefore, highly accurate color superimposition adjustment can be performed without being influenced by the rotational irregularity of the image carrier, or by the rotational irregularity of the transfer carrier driving means. Besides, when s is 1, it is possible to reduce the amount of developer used for forming combined images compared to the case where s is not less than 2. Thus, when s is 1, it is possible to save the developer.

When t is a natural number not less than 2, s is expressed as 1/(2t), and t same combined images are continuously formed so that the pitch of the same combined images is 1/t times the circumference length. Specifically, a plurality of same combined images are formed by mainly using regions which are the regions on the respective image carriers and are equally distributed. However, since there is rotational irregularity in each image carrier, the plurality of same combined images do not have the same shape in the strict sense.

Furthermore, the rotational irregularity of each image carrier has a cycle in each rotation of the image carrier, and the peripheral velocity of the image carrier shows a velocity change as shown by the sine curve. Therefore, in the case where a plurality of combined images are formed under the above-mentioned conditions, the density average values of the respective combined images are detected and then the average of the respective density values is calculated, sampling is performed so that the rotationally irregularity can be cancelled, instead of uneven sampling. Consequently, a detection result (the average of the respective density values) similar to the value obtained when there is no rotational irregularity will be obtained.

Thus, color superimposition adjustment can be performed without being influenced by the rotational irregularity of the image carrier. Furthermore, when the combined images are formed in the above-mentioned manner, a region where the combined image is not formed appears at a pitch 1/t times the circumference length of the image carrier. It is therefore possible to further reduce the amount of developer used for forming the combined images.

Besides, when there is rotational irregularity in the transfer carrier driving means, the moving velocity of the transfer belt at the contact portion changes in a constant cycle corresponding to the rotational irregularity. Here, by defining s as described above and forming t same combined images continuously so that the pitch of the same combined images is 1/t times the circumference length, sampling will be performed so that the rotational irregularity can be canceled, instead of uneven sampling. Consequently, a detection result (the average of the respective density values) similar to the value obtained when there is no rotational irregularity will be obtained. Thus, color superimposition adjustment can be performed without being influenced by the rotational irregularity of the transfer carrier driving means.

In this case, a region where the combined image is not formed will also appear at a pitch 1/t times the circumference length of the transfer carrier driving means. It is therefore possible to further reduce the amount of developer used for forming the combined images.

Here, t is defined as 2. As described above, when there is rotational irregularity in the image carrier or the transfer carrier driving means, in order to achieve further accurate color superimposition adjustment, the length in sub-scanning direction of each combined image is adjusted to a length calculated by adding the sub-scanning direction length of the detection surface of the density detecting means to a length 1/(2t) times the circumference length of the image carrier or the transfer carrier driving means. Specifically, in this case, for each combined image, in addition to the length 1/(2t) times the circumference length of the image carrier or the transfer carrier driving means, it is necessary to form an image with a length equal to the sub-scanning direction length of the detection surface of the density detecting means. Therefore, if the value of t is increased too much, the effect of reducing the developer by a region where no combined image is formed can not be obtained.

Thus, by defining the value of t as 2, the amount of developer to be used can be significantly reduced. Additionally, there is the advantage that the control during the formation of each combined image and the control during the detection of the density average value of the combined image will not be complicated.

Further, when the different color component images are composed of a reference image of a color component whose superimposing position is fixed and a correction image of a color component to be subjected to superimposing position adjustment, in the combined images formed by superimposing the different color component images at respectively different positions, the superimposing positions of the correction images with respect to the reference images are shifted from each other by a fixed distance.

Here, if color superimposition adjustment is performed by setting the fixed distance, for example, to a very small distance (for example, 1 dot), the adjustment is susceptible to the influence of the rotational irregularity of the image carrier, or of the rotational irregularity of the transfer carrier driving means. Therefore, even when performing such precise color superimposition, it is possible to make accurate color superimposition adjustment.

Furthermore, when forming a new combined image by changing the superimposing position of the correction image, the new combined image is formed continuously, without an interval, after a previous combined image formed before changing the superimposing position. Specifically, when forming a combined image by further shifting the position of the correction image by the fixed distance with respect to the reference image, a combined image formed immediately before shifting the correction image and a combined image formed immediately after shifting the correction image are always continuous. Accordingly, it is possible to reduce the number of regions where the combined image is not formed, which shall appear between respective combined images. Therefore, the time taken for the color superimposition adjustment can be shortened.

The above and further objects and features of the invention will more fully be apparent from the following detailed description with accompanying drawings.

DETAILED DESCRIPTION OF THE INVENTION

The following description will explain embodiments of the present invention with reference to FIG. 1 through FIG. 18.

Figure 1:
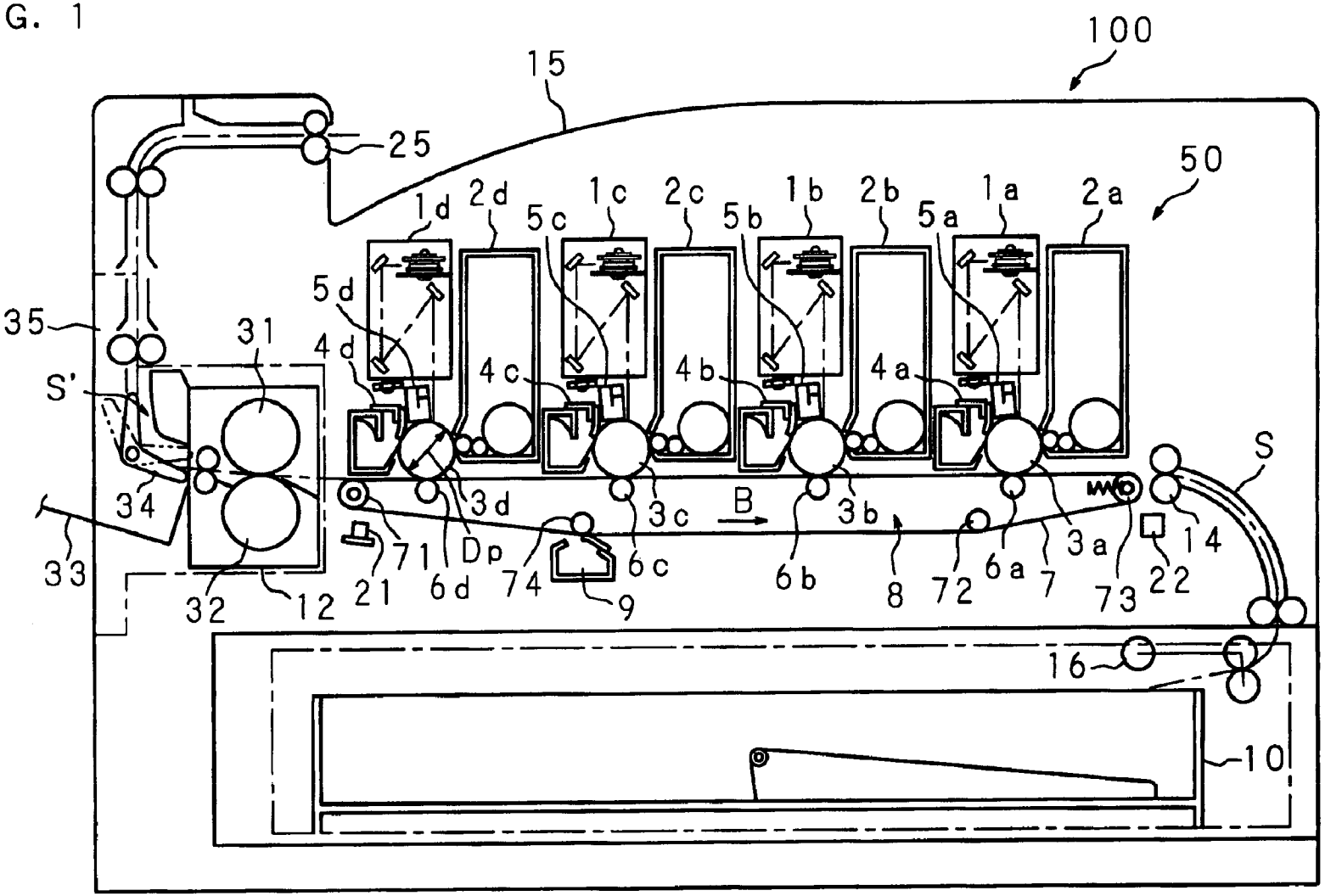
FIG. 1 is a schematic view showing the schematic configuration of an image forming apparatus of the present invention.

FIG. 1 is a schematic view showing the schematic configuration of an image forming apparatus according to an embodiment of the present invention. An image forming apparatus 100 of this embodiment forms a multi-color or monochrome image on a recording sheet, according to image data inputted from outside. In addition to the structure involved in color superimposition adjustment for correcting color misregistration of a multi-color image, the image forming apparatus 100 comprises, as shown in FIG. 1, a sheet feed tray 10, sheet discharge trays 15, 33, and a fixing unit 12. The structure involved in color superimposition adjustment for correcting color misregistration of a multi-color image will be described in detail later.

The sheet feed tray 10 is a tray for storing recording sheets on which images are to be recorded. The sheet discharge trays 15 and 33 are trays on which the recording sheets with images recorded thereon are placed. The sheet discharge tray 15 is disposed in an upper part of the image forming apparatus 100, and a recording sheet on which an image has been printed is placed face down. The sheet discharge tray 33 is provided in a side part of the image forming apparatus 100, and a recording sheet on which an image has been printed is placed face up.

The fixing unit 12 has a heat roller 31 and a pressure roller 32. The heat roller 31 is set to a predetermined temperature based on a detected temperature value. The heat roller 31 and the pressure roller 32 rotate while holding a recording sheet to which a toner image has been transferred between them. Therefore, with the heat of the heat roller 31, the toner image is fixed onto the recording sheet by heat and pressure.

Next, the following description will explain the structure involved in color superimposition adjustment for correcting color misregistration of a multi-color image in the image forming apparatus 100. Here, color superimposition adjustment called the first color superimposition adjustment and the second color superimposition adjustment will be explained first, and then an explanation is given for color superimposition adjustment that takes into account the rotational irregularity of an image carrier and color superimposition adjustment that takes into account the rotational irregularity of a transfer driving roller for driving a transfer carrier, which are the characteristics of the present invention.

The image forming apparatus 100 comprises, as the structure involved in color misregistration correction, an image forming station 50, a transfer and transport belt unit 8, a registration detecting sensor 21 (density detecting means), and a temperature/humidity sensor 22.

The image forming station 50 forms a multi-color image by using black (K), cyan (C), magenta (M) and yellow (Y) colors. Moreover, in order to form four kinds of latent images corresponding to the respective colors, the image forming station 50 comprises light exposure units 1*a*, 1*b*, 1*c*, 1*d*; developing devices 2*a*, 2*b*, 2*c*, 2*d*; photosensitive drums 3*a*, 3*b*, 3*c*, 3*d*; cleaner units 4*a*, 4*b*, 4*c*, 4*d*; and charging devices 5*a*, 5*b*, 5*c*, 5*d* corresponding to the respective colors. Note that "a", "b", "c" and "d" correspond to black (K), cyan (C), magenta (M), and yellow (Y), respectively.

In the following description, the four members provided for the respective colors are collectively referred to as the light exposure unit 1, the developing device 2, the photosensitive drum 3, the cleaner unit 4, and the charging device 5, except for the case where a member corresponding to a specific color is specified.

The light exposure unit 1 is a write head, such as EL and LED, composed of light emitting elements arranged in an array, or a laser scanning unit (LSU) comprising a laser irradiation section and a reflective mirror. Note that, in this embodiment, as shown in FIG. 1, the LSU is used. By exposing the photosensitive drum 3 according to the inputted image data, the light exposure unit 1 forms an electrostatic latent image corresponding to the image data on the photosensitive drum 3.

The developing device 2 develops the electrostatic latent image formed on the photosensitive drum 3 into a visible image by toner of each color. The photosensitive drum 3 (image carrier) is disposed at the center of the image forming apparatus 100. The photosensitive drum 3 forms on its surface an electrostatic latent image and a toner image corresponding to the inputted image data.

After the electrostatic latent image formed on the surface of the photosensitive drum 3 has been developed into a visible image and transferred to a recording sheet or the like, the cleaner unit 4 removes and collects the toner remaining on the photosensitive drum 3. The charging device 5 uniformly charges the surface of the photosensitive drum 3 to a predetermined potential. As the charging device 5, it is possible to use a roller type charging device and a brush type charging device which come into contact with the photosensitive drum 3. In addition, a charger type charging device which does not come into contact with the photosensitive drum 3 may be used as the charging device 5. Note that, in this embodiment, the charger type charging device is used.

The transfer and transport belt unit 8 is disposed under the photosensitive drum 3. The transfer and transport belt unit 8 comprises a transfer belt 7 (transfer carrier), a transfer belt driving roller 71 (transfer carrier driving means), a transfer belt tension roller 73, transfer belt driven rollers 72, 74, transfer rollers 6*a*, 6*b*, 6*c*, 6*d*, and a transfer belt cleaning unit 9. Hereinafter, the four transfer rollers 6*a*, 6*b*, 6*c*, 6*d* corresponding to the respective colors are collectively referred to as the transfer roller 6.

The transfer belt driving roller 71, transfer belt tension roller 73, and transfer belt driven rollers 72, 74 are members for stretching the transfer belt 7 thereon and driving and rotating the transfer belt 7 in the direction of arrow B.

The transfer roller 6 is rotatably supported on the housing of the transfer and transport belt unit 8. The transfer roller 6 comprises a metal shaft with a diameter of 8 to 10 mm as a base, and its surface is covered with a conductive elastic material such as EPDM and urethane foam. By using the conductive elastic material, a high voltage of the polarity opposite to the charged polarity of the toner can be uniformly applied to the recording sheet. Consequently, the toner image formed on the photosensitive drum 3 is transferred to the transfer belt 7, or a recording sheet which is transported while being attracted onto the transfer belt 7.

The transfer belt 7 is formed using polycarbonate, polyimide, polyamide, polyvinylidene fluoride, polytetrafluoroethylene copolymer, or ethylene tetrafluoroethylene copolymer. The transfer belt 7 is placed so that it comes into contact with the photosensitive drum 3. By sequentially transferring the toner images of the respective colors formed on the photosensitive drum 3 to the transfer belt 7, or the recording sheet which is transported while being attracted onto the transfer belt 7, a multi-color toner image is formed. The transfer belt 7 has a thickness of 100 $\mu$m or so, and is produced in an endless form by using a film. Moreover, the transfer belt 7 is non-transparent and has black color.

The transfer belt cleaning unit 9 removes and collects toner for color superimposition adjustment and toner for process control, which adhere to the transfer belt 7 due to direct transfer. The transfer belt cleaning unit 9 also removes and collects toner which adheres to the transfer roller 7 due to contact with the photosensitive drum 3.

In order to detect a patch image formed on the transfer belt 7, the registration detecting sensor 21 is disposed in a position, which is a position where the transfer belt 7 has just passed the image forming station 50 and in front of the transfer cleaning unit 9. This registration detecting sensor 21 detects the density of the patch image formed on the transfer belt 7 by the image forming station 50.

The temperature/humidity sensor 20 detects the temperature and humidity in the image forming apparatus 100. This temperature/humidity sensor 22 is disposed in the vicinity of a processing section where there is no abrupt change in temperature or humidity.

The transfer belt 7 is driven and rotated by the transfer belt driving roller 71, transfer belt tension roller 73, transfer belt driven rollers 72, 74, and transfer roller 6. Therefore, the respective color component toner images are sequentially transferred one upon another onto the transfer belt 7 or the recording sheet which is transported while being attracted onto the transfer belt 7, so that a multi-color toner image is formed. In the case where the multi-color toner image is formed on the transfer belt 7, this multi-color toner image is further transferred onto the recording sheet.

When performing color superimposition adjustment in the image forming apparatus 100 according to this embodiment, the respective color component toner images formed by the image forming station 50 are transferred onto the transfer belt 7. At this time, if the toner image of any one of the color components among the respective color component toner images is given as a reference toner image, first, this reference toner image (reference image) is transferred onto the transfer belt 7. Then, the other color component toner image (correction image) to be subjected to color misregistration correction is transferred onto this reference image. The reference image and the correction image are hereinafter referred to as the reference patch image and the correction patch image, respectively.

Here, a sequence of image forming operations of the image forming apparatus 100 is explained.

When image data is inputted into the image forming apparatus 100, the light exposure unit 1 exposes the surface of the photosensitive drum 3 so that an image corresponding to the inputted image data is formed in an adjustment position calculated by later-described color superimposition adjustment, thereby forming an electrostatic latent image on the photosensitive drum 3.

The electrostatic latent image is developed into a toner image by the developing device 2. Meanwhile, one sheet of the recording sheets stored in the sheet feed tray 10 is separated by a pickup roller 16 and transported to a sheet transport path S, and temporarily held by resist rollers 14. Based on a detection signal of a registration pre-detection switch, not shown, the resist rollers 14 control the transport timing so that the leading end of the toner image on the photosensitive drum 3 is aligned with the leading end of the image formation region of the recording sheet, and then transport the recording sheet to the transfer belt 7 in accordance with the rotation of the photosensitive drum 3. The recording sheet is transported while being attracted onto the transfer belt 7.

The transfer of the toner image from the photosensitive drum 3 to the recording sheet is carried out by the transfer roller 6 which is disposed to face the photosensitive drum 3 with the transfer belt 7 therebetween. A high voltage having the polarity opposite to the toner is applied to the transfer roller 6, thereby applying the toner image to the recording sheet. Four kinds of toner images corresponding to the respective colors are superimposed sequentially on the recording sheet transported by the transfer belt 7.

Thereafter, the recording sheet is transported to the fixing unit 12, and the toner images are fixed on the recording sheet with heat and pressure. Then, the transport path is switched by a transport switching guide 34, so that the recording sheet with image is transported to the sheet discharge tray 33, or to the sheet discharge tray 15 via a sheet transport path S'.

When the transfer to the recording sheet has been completed, the collection/removal of the toner remaining on the photosensitive drum 3 is performed by the cleaner unit 4. Moreover, the transfer belt cleaning unit 9 performs the collection/removal of the toner adhering to the transfer belt 7, so that a sequence of image forming operations is completed.

Note that although the image forming apparatus 100 of this embodiment is a direct transfer type image forming apparatus in which a recording sheet is carried on the transfer belt 7 and the toner images formed on the respective photosensitive drums are superimposed on the recording sheet, the present invention is not necessarily limited to this. The present invention may be applied to an intermediate transfer type image forming apparatus in which the toner images formed on the respective photosensitive drums are transferred onto the recording sheet one upon another, and then collectively transferred to the recording sheet again to form a multi-color image.

Figure 2:
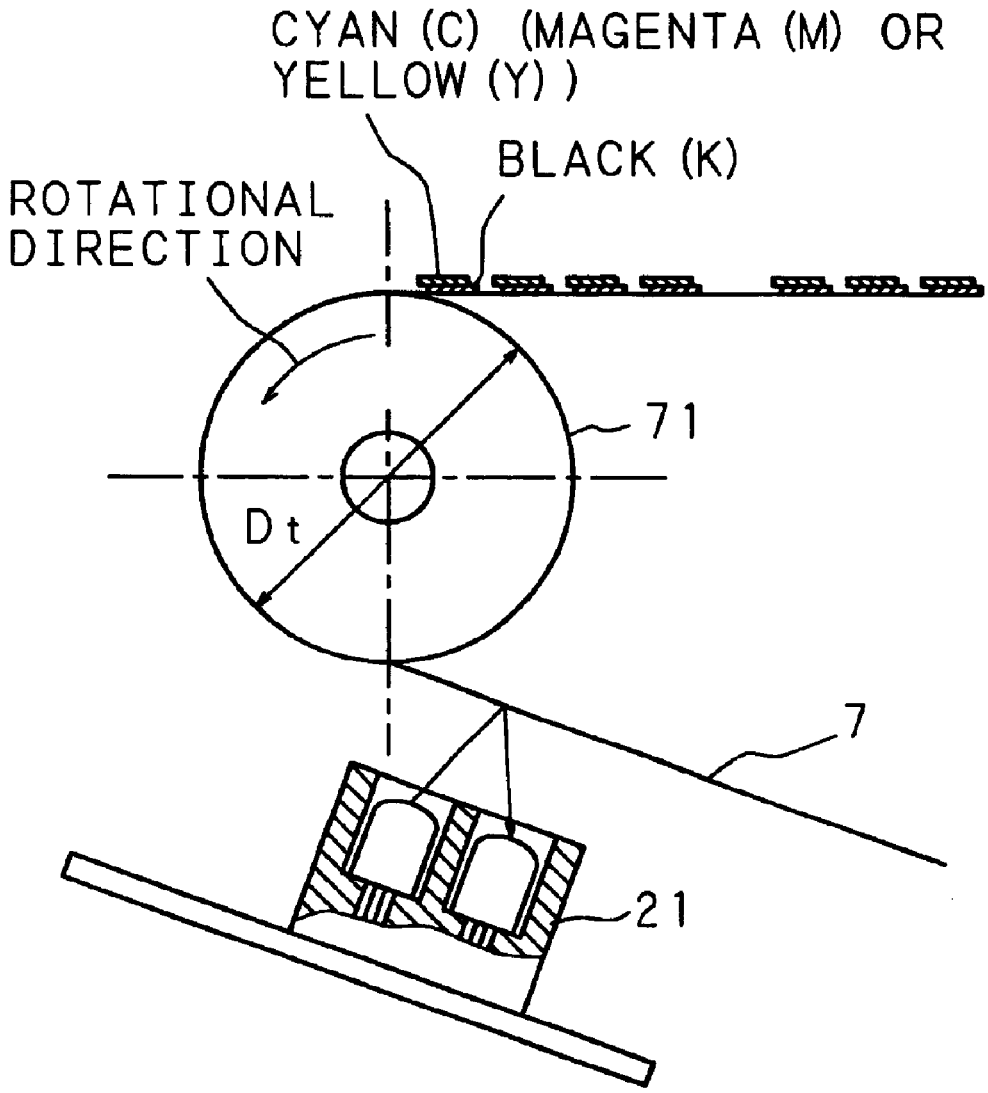
FIG. 2 is an explanatory view showing the toner images formed on a transfer belt when transferring, for example, a toner image of cyan (C) color component to be a correction patch image onto a toner image of black (K) color component to be a reference patch image.

FIG. 2 is an explanatory view showing the toner images formed on the transfer belt 7 by transferring a black (K) color component toner image as a reference patch image and transferring a cyan (C) color component toner image to be a correction patch image, for example, onto the reference patch image.

As described above, the transfer belt 7 is driven and rotated by the transfer belt driving roller 71, etc. mounted in the transfer and transport belt unit 8. Therefore, as shown in FIG. 2, when the reference patch image and the correction patch image formed on the transfer belt 7 reach the position of the registration detecting sensor 21, an average value of the density (hereinafter referred to as the density average value) of the reference patch image and correction patch image on the transfer belt 7 is detected by the registration detecting sensor 21.

More specifically, the registration detecting sensor 21 irradiates light on the transfer belt 7 and detects light reflected on the transfer belt 7. Accordingly, the density average value of the reference patch image and correction patch image is detected. Then, based on this detection result, the light exposure unit 1 corrects the exposure timing, and corrects the write timing onto the photosensitive drum 3.

Note that, as shown in FIG. 2, although the registration detecting sensor 21 is disposed so that the emission position of irradiated light and the detection position of reflected light are parallel to the conveying direction of the transfer belt 7, it is not necessarily limited to this. For example, with the use of a mirror or the like, the registration detecting sensor 21 may be disposed so that the emission position of irradiated light and the detection position of reflected light are perpendicular to the conveying direction of the transfer belt 7.

Moreover, in this embodiment, the processing speed of image formation is set at 100 mm/sec, and the registration detecting sensor 21 performs detection in a sampling cycle of 2 msec.

Next, the following description will explain in detail a color superimposition adjustment method employed by the image forming apparatus 100 having such a configuration.

The first color superimposition adjustment method will be explained first. Then, the second color superimposition adjustment method will be explained.

This embodiment is explained by using a black (K) toner image as a reference patch image and a cyan (C) toner image as a correction patch image. First, an explanation is given for the case where the color superimposition adjustment range is 99 dots (lines) in the conveying direction of the transfer belt 7 and the color superimposition adjustment direction is a sub-scanning direction. Here, the color superimposition adjustment range composed of 99 dots (lines) in the conveying direction of the transfer belt 7 means that the timing of forming the correction patch image during the formation of a single image for detection, which is composed of the reference patch image and the correction patch image, can be changed within the range of 99 dots in the conveying direction of the transfer belt 7. Further, for the sake of explanation, the first adjustment position in this adjustment range is referred to as the 1st dot adjustment position, and the last adjustment position in this adjustment range is referred to as the 99th dot adjustment position.

Note that the colors of toner images to be used as the reference patch image and the correction patch image are not particularly limited, and any colors may be used. Moreover, the color superimposition adjustment range is not necessarily limited to the adjustment range of 99 dots, and may be set to a narrower range or a wider range. Further, the adjustment range may be changed according to conditions. In any case, when the adjustment range is wide, it takes a long time for the color superimposition (registration) adjustment, whereas, when the adjustment range is narrow, it takes a short time for the color superimposition (registration) adjustment.

The color superimposition adjustment performed in the image forming apparatus 100 of this embodiment is carried out by forming, on the transfer belt 7, a reference patch image and a correction patch image, each composed of a plurality of lines extending in a direction (hereinafter referred to as the main scanning direction) perpendicular to conveying direction (hereinafter referred to as the subscanning direction) of the transfer belt 7 and arranged in the sub-scanning direction. The lines constituting the reference patch image are hereinafter referred to as the reference lines, and the lines constituting the correction patch image are hereinafter referred to as the correction lines.

Figure 3:
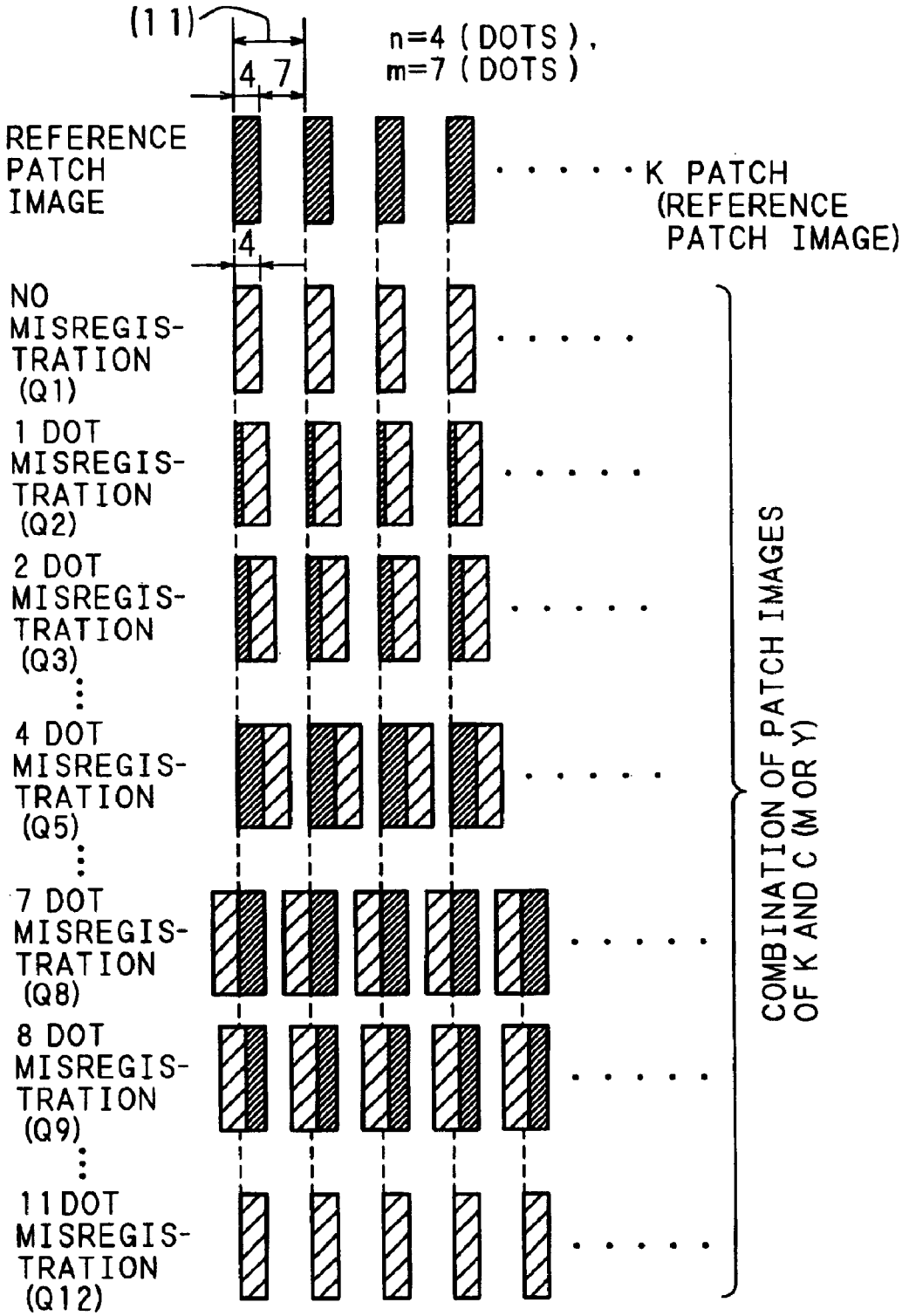
FIG. 3 is an explanatory view showing the outline of the first color superimposition adjustment method.

FIG. 3 is an explanatory view showing the outline of the first color superimposition adjustment method. First, as shown in FIG. 3, a reference patch image having, for example, a line width n of 4 dots and a line spacing m of 7 dots between the lines, is formed on the transfer belt 7. Specifically, the pitch (m+n) of the pattern of the reference line is set to 11 dots. Note that the reference line is a black (K) line. After forming the reference patch image composed of the reference lines, the correction patch image having the same line width n and line spacing m as the reference patch image is formed over the reference patch image.

Subsequently, the density average value of a region including the reference lines and correction lines formed on the transfer belt 7 is detected by the registration detecting sensor 21.

Figure 4:
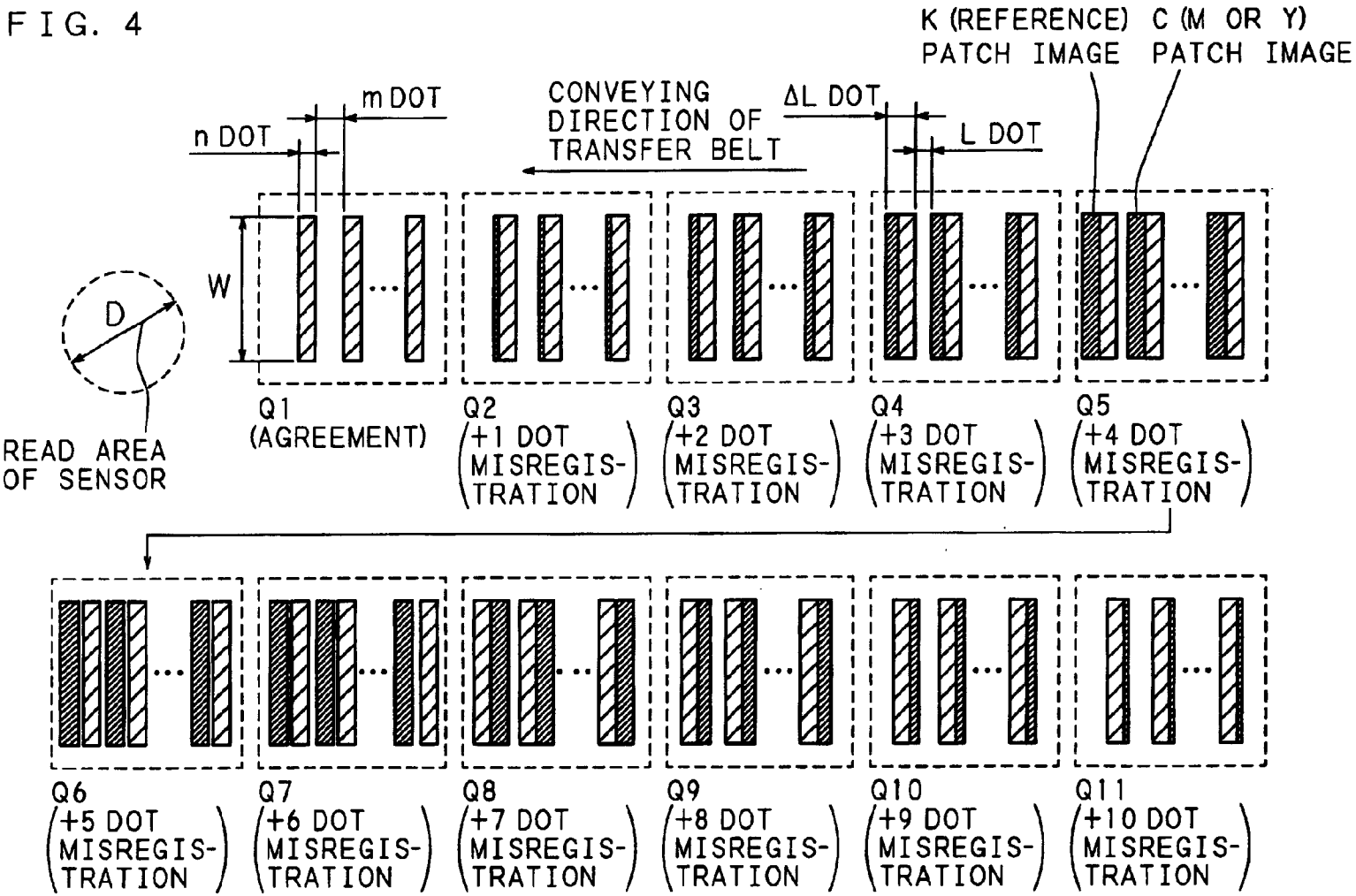
FIG. 4 is an explanatory view showing combined images formed by shifting correction lines at a rate of 1 dot in a sub-scanning direction with respect to reference lines.

FIG. 4 is an explanatory view showing combined images formed by shifting the correction lines with respect to the reference lines at a rate of 1 dot in the sub-scanning direction.

As shown in FIG. 4, the registration detecting sensor 21 detects the density average value of a region including the reference lines and correction lines, within the read area of the registration detecting sensor 21. The read range of the registration detecting sensor 21 of this embodiment is a circular region with a diameter of about 10 mm, and can average detection errors caused by color misregistration due to small vibrations, etc. Moreover, according to the timing of superimposing the correction line, the reference patch image and the correction patch image form a single combined image (the image enclosed by the dotted line in FIG. 4) composed of several tens to several hundreds of reference lines and of correction lines. In addition, plural sets of combined images are formed by changing the timing of superimposing the correction lines.

Here, the density average value in the region including the reference lines and correction lines to be subjected to the detection by the registration detecting sensor 21 varies depending on the superimposed state of the reference line and the correction line on the transfer belt 7. Specifically, according to the degree of overlapping of the reference line and the correction line, the detection value of reflected light detected by the registration detecting sensor 21 will change. In other words, the detection result of the registration detecting sensor 21 will change according to the total area of the reference lines and correction lines formed on the surface of the transfer belt 7. When this area is a minimum, i.e., when the reference line and the correction line perfectly overlap, the light quantity absorbed by the reference line and correction line, in the light emitted from the registration detecting sensor 21, becomes a minimum. In other words, the light quantity of reflected light from the transfer belt 7 becomes a maximum. Accordingly, the density average value as the detection value detected by the registration detecting sensor 21 becomes higher. In the case where a transparent transfer belt is used in place of the transfer belt 7, similar detection can be performed by using a transmission type registration detecting sensor instead of the reflection type registration detecting sensor 21.

As described above, when the reference line and the correction line perfectly overlap, the detection value becomes a maximum. Specifically, when image formation is performed in the conditions in which the detection value becomes a maximum (or the detection value becomes a minimum in the case of using a transparent transfer belt), it is possible to obtain a state in which the reference line and the correction line perfectly overlap. In this first color superimposition adjustment, by noticing the fact that the detection value becomes a maximum when the reference line and the correction line perfectly overlap, color superimposition is performed so that the detection value becomes a maximum. However, the first color superimposition adjustment is not necessarily limited to this. For example, it is possible to find a state in which the reference line and the correction line are completely displaced from each other, i.e., a state in which the detection value becomes a minimum. In this case, however, the state in which the detection value becomes a maximum shall be calculated from the state in which the detection value becomes a minimum.

As described above, in this embodiment, since the non-transparent black transfer belt 7 is used, when the reference line and the correction line perfectly overlap, the detection value of the registration detecting sensor 21 becomes a maximum. Therefore, as shown in FIG. 3, the correction line to be formed on the reference line is shifted at an arbitrary rate so as to change the superimposed state of the reference line and the correction line. Then, by obtaining the detection values detected by the registration detecting sensor 21 for the respective states of the shifted correction lines, a state in which the detection value becomes a maximum is found.

Here, as described above, in the case where both of the reference line and the correction line are a plurality of lines with a line width n of 4 dots and a line spacing m of 7 dots between lines, when the reference line and the correction line perfectly overlap, the reference line is perfectly covered with the correction line as shown by Q1 in FIG. 4. Specifically, the registration detecting sensor 21 detects the density average value of an image composed of repetitions of a 4-dot line width corresponding to the state in which 4 dots of the reference line and 4 dots of the correction line overlap and a 7-dot line spacing, i.e., of an image with a line pitch of 11 dots.

Next, when the correction line is shifted from the formation position of the reference line by 1 dot in the sub-scanning direction (hereinafter referred to as "+1 dot misregistration"), as shown by Q2 in FIG. 4, a displaced state in which the reference line is not perfectly covered with the correction line is produced. In this case, the registration detecting sensor 21 detects alternately a 5-dot line width composed of the 4-dot wide reference line and the correction line which has a 4-dot width and is shifted from the reference line by 1 dot, and a 6-dot line spacing. In other words, the registration detecting sensor 21 detects the density average value of an image formed by repetitions of the 5-dot line width composed of the reference line and the correction line, and the 6-dot line spacing.

Thus, when the correction line is shifted 1 dot by 1 dot in the sub-scanning direction from the Q1 state shown in FIG. 4, the superimposed state of the reference line and the correction line will change as shown by Q1 to Q12 in FIG. 3 and FIG. 4. Then, when the correction line is shifted by +11 dots from the Q1 state shown in FIG. 4, the resulting image is composed of repetitions of a 4-dot line width and a 7-dot line spacing as shown by Q12 in FIG. 3. In short, the state in which the reference line and the correction line perfectly overlap is produced again.

Hence, the state in which the correction line is shifted by 11 dots is equal to the state before shifting the correction line, and the same state is repeatedly produced whenever the correction line is shifted by 11 dots.

In this embodiment, as described above, the color superimposition adjustment range is a range of 99 dots (lines) in the conveying direction of the transfer belt 7. Specifically, by shifting the position of the correction line 1 dot by 1 dot with respect to the reference line, the position of the correction line can be set to 99 different positions. For example, suppose that the position of the correction line at which the detection of the density average value is started is the 50th dot adjustment position that is the center of the color superimposition adjustable range (from the 1st dot adjustment position to the 99th dot adjustment position). In this state, first, the reference line and the correction line are formed on the transfer belt 7, and then the density average value in the region including the reference line and correction line is obtained.

Next, by shifting the correction line by 1 dot, the reference line and the correction line to be the 51st dot adjustment position are formed on the transfer belt 7. Then, the density average value in the region including the reference line and the correction line is obtained. Further, the same processing as above is repeated so that the reference line and the correction line to be the 60th dot adjustment position which is shifted by 10 dots with respect to the 50th dot adjustment position are finally formed on the transfer belt 7. Then, the density average value in the region including the reference line and correction line is measured. Specifically, a total of 11 kinds of combined image patterns are formed, and the densities of the combined image patterns are detected. Note that even when the reference line and the correction line to be the 61st dot adjustment position which is shifted by 11 dots with respect to the 50th dot adjustment position are formed on the transfer belt 7, the detection result will be the same as that for the correction line on the 50th dot adjustment position, and therefore the formation of the correction line to be the 61st dot adjustment position is not performed.

As described above, in this embodiment, the correction line is formed for each of these eleven positions and superimposed on the reference line, and then the density average value is detected. Next, a position of the correction line where the detection value becomes a minimum is determined. In other words, an exposure timing in which the reference color component image and other color component image to be subjected to adjustment (correction) are in perfect register with each other is obtained.

Figure 5:
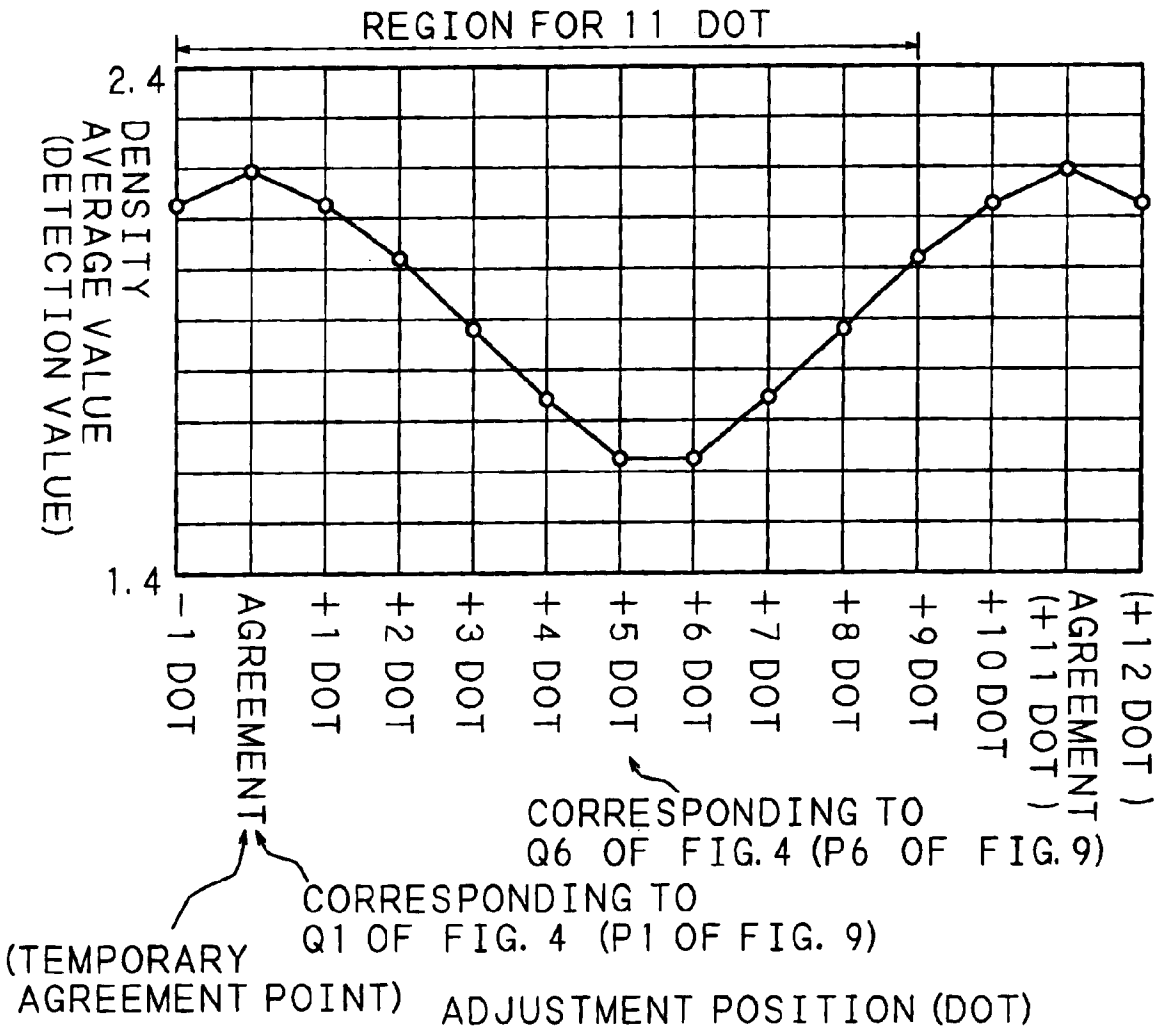
FIG. 5 is a graph showing the density average value of a region including the reference lines and correction lines within the sensor read area of a registration detecting sensor, for each superimposed state of the reference line and the correction line.

FIG. 5 is a graph showing the density average value in the region including the reference lines and correction lines within the sensor read area (in this embodiment, a circular region with a diameter D=10 mm) of the registration detecting sensor 21, for each superimposed state of the reference line and the correction line.

Here, as described above, the density average value (detection value) becomes a maximum when the reference line and the correction line perfectly overlap. If the formation position of the correction line corresponding to this state is a temporary agreement point, then FIG. 5 shows that the beginning state is a state in which the correction line is shifted by −1 dot from the temporary agreement point, and that the reference line and the correction line overlap when the correction line is shifted by +1 dot. As described above, if the position of the correction line at which the detection of density starts is the 50th dot adjustment position, the correction line on this 50th dot adjustment position is in a −1 dot misregistration state. Then, the temporary agreement point is the 51st dot adjustment position.

However, as described above, whenever the correction line is shifted by 11 dots, the same state is repeated. In short, this temporary agreement point is not always a position where the respective color components are accurately superimposed in every image formation (hereinafter referred to as the true agreement point).

Namely, the 62nd dot adjustment position corresponding to the +11 dot misregistration state, the 73rd dot adjustment position corresponding to the +22 dot misregistration state, the 84th dot adjustment position corresponding to the +33 dot misregistration state, or the 95th dot adjustment position corresponding to the +44 dot misregistration state may be the true agreement point. Or, any one of the 40th dot adjustment position corresponding to the −11 dot misregistration state, the 29th dot adjustment position corresponding to the −22 dot misregistration state, the 18th dot adjustment position corresponding to the −33 dot misregistration state, and the 7th dot adjustment position corresponding to the −44 dot misregistration state may be the true agreement point.

In short, any one of these nine points is the true agreement point, and, in this stage, namely, the first color registration stage, it is only possible to predict candidates of the true agreement point. In other words, by correcting the exposure timing of the light exposure unit 1 for forming the correction line, even when a position of a correction line at which the detection value of the registration detecting sensor 21 becomes a maximum is selected, the reference color component image and other color component image to be subjected to adjustment may be or may not be superimposed perfectly.

Therefore, in order to find the true agreement point of the reference color component image and other color component image to be subjected to adjustment from the 51st dot adjustment position found by the first color superimposition adjustment and other eight candidate positions which can be calculated from the 51st dot adjustment position, the second color superimposition adjustment is performed.

Note that, in the above-described example, an adjustment position where the reference line and the correction line perfectly overlap, i.e., an adjustment position where the density value becomes a maximum, is found in the first color superimposition adjustment. However, an adjustment position where the reference line and the correction line are completely displaced from each other, i.e., an adjustment position where the density value becomes a minimum, may be found.

In this case, in order to facilitate the detection of the adjustment position where the density value becomes a minimum, it is necessary to form additionally a pattern for use in detection. Here, for example, suppose that n is 4 dots, m is 6 dots, and the pitch (n+m) of the pattern of the reference line and the correction line is 10 dots. In this case, the adjustment position where the density value becomes a minimum, namely the 56th dot adjustment position, is found. Then, by shifting the correction line by −5 dots from the 56th dot adjustment position, it is possible to determine that the 51st dot adjustment position is the adjustment position where the density value becomes a maximum.

Next, the second color superimposition adjustment will be explained.

In the second color superimposition adjustment, at the positions where the detection value of the registration detecting sensor 21 becomes a maximum, which were found by the first color superimposition adjustment, writing onto the photosensitive drum 3 is performed by exposure of the light exposure unit 1, and the reference patch image and the correction patch image are formed on the transfer belt 7. The reference patch image and correction patch image to be formed at this time are formed based on the number d of dots (d=m+n) per pitch of the reference line and the correction line in the first color superimposition adjustment. For example, the line width of the reference patch image is set to a number of dots (8d), which is 8 times larger than d, the line spacing of the reference patch image is set to d, the line width of the correction patch image is set to d, and the line spacing of the correction patch image is set to a number of dots (8d), which is 8 times larger than d. Note that the line width of the reference patch image, the line spacing of the reference patch image, the line width of the correction patch image, and the line spacing of the correction patch image are not necessarily limited to these values.

Here, since n is 4 dots and m is 7 dots in the first color registration adjustment, the line width (d) of the correction patch image is 11 dots, and the line spacing (8d) of the correction patch image is 88 dots. Besides, the line width (8d) of the reference patch image is 88 dots, and the line spacing (d) of the reference patch image is 11 dots. Accordingly, the color superimposition adjustment range is a range of 99 dots in the conveying direction of the transfer belt 7. Note that, when a change in the color superimposition adjustment range is desired, the range can be widened or narrowed by increasing or decreasing the factor (8) of d representing the line width of the reference patch image and the line spacing of the correction patch image. For example, by setting the factor of d to 9 instead of 8, the color superimposition adjustment range can be changed to a range of 110 dots. Alternatively, by setting the factor of d to 7, the color superimposition adjustment range can be changed to a range of 88 dots.

Thus, in the second color superimposition adjustment, the line width of the reference patch image, the line spacing of the reference patch image, the line width of the correction patch image and the line spacing of the correction patch image are set in accordance with a color registration adjustment range. In short, settings can be made so that the line pitches of the reference patch image and the correction patch image are equal to the number of dots in a required color superimposition adjustment range. In this embodiment, as described above, the color superimposition adjustment range is 99 dots. Accordingly, the following explanation is given by supposing that the line width of the reference patch image is 8 d, the line spacing of the reference patch image is d, the line width of the correction patch image is d, and the line spacing of the correction patch image is 8 d.

In the second color superimposition adjustment, like the first color superimposition adjustment, first, the correction patch images are formed by respectively shifting them with respect to the reference patch images by a number of dots corresponding to the pitch of the patch image in the first color superimposition adjustment. More specifically, the correction lines are formed by shifting them d dots by d dots which are the width of the correction line. Thereafter, with the use of the registration detecting sensor 21, the density average value of a region including the reference line and the correction line is found.

Figure 6:
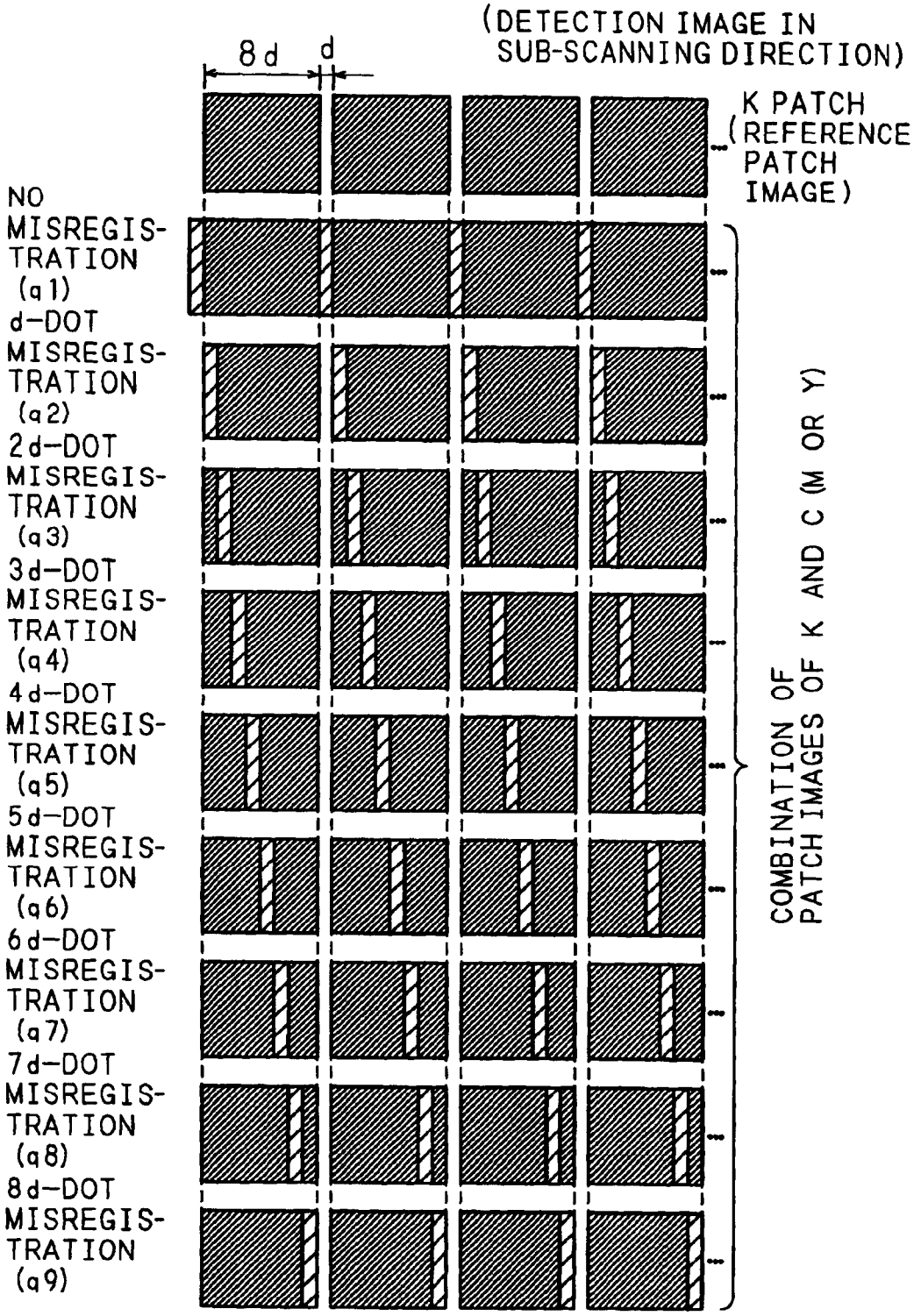
FIG. 6 is an explanatory view showing the outline of the second color superimposition adjustment method.

FIG. 6 is an explanatory view showing the outline of the second color superimposition adjustment method.

In this second color superimposition adjustment, settings are made so that, when the position of the reference color component image and the position of other color component image to be subjected to adjustment are in perfect register with each other, the formation position of the reference patch image and that of the correction patch image are completely displaced from each other. Therefore, as shown by q1 (no misregistration) in FIG. 6, a state in which a correction patch image is formed between reference patch images without overlapping the reference patch images represents the state in which the position of the reference color component image and the position of other color component image to be subjected to adjustment are in perfect register with each other. In other words, a state in which the reference patch image and the correction patch image are connected continuously, i.e., a state without an interval in the sub-scanning direction on the transfer belt 7, is the state in which the position of the reference color component image and the position of other color component image to be subjected to adjustment are in perfect register with each other. The formation position of the correction line that brings about such a state is the above-mentioned true agreement point.

On the other hand, if the formation position of the reference patch image and that of the correction patch image are not in perfect register and the reference patch image and correction patch image are in a state shifted from the q1 state, then the correction patch image is formed over the reference patch image. This state indicates that the position of the reference color component image and the position of other color component image to be subjected to adjustment are displaced from each other. This also shows that the formation position of the correction line that brings about such a state is the temporary agreement point, but not the true agreement point.

Figure 7:
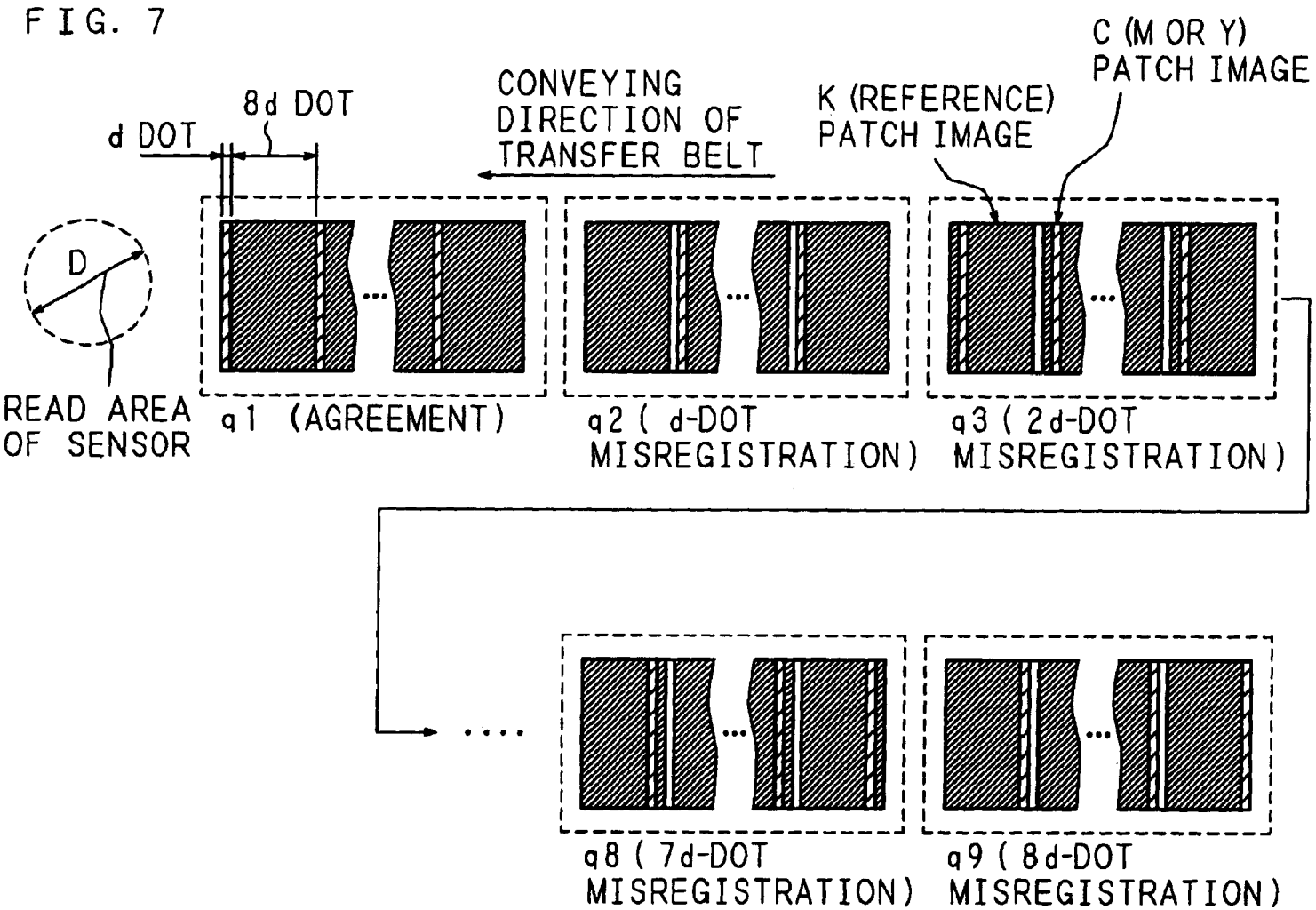
FIG. 7 is an explanatory view showing combined images formed by shifting the correction lines with respect to the reference lines at a rate of d dots (11 dots) in the sub-scanning direction.

FIG. 7 is an explanatory view showing combined images formed by shifting the correction lines with respect to the reference lines at a rate of d dots (11 dots) in the sub-scanning direction.

Here, as shown in FIG. 6 and FIG. 7, the correction lines are shifted d dots by d dots from the q1 state. The correction patch image is shifted up to the q9 state that is the state shifted by 8d dots from the q1 state of the correction line. Note that, although not shown in the drawings, if the correction line is further shifted by d dots, the same state as the beginning q1 state is produced again. However, since this is beyond the color registration adjustment range, the density average values of the images are detected for 9 kinds of shifted image patterns, q1 to q9. Note that FIG. 6 and FIG. 7 are merely the drawings used for the sake of explanation, and the aim of the second color superimposition adjustment is to obtain the q1 state by shifting the correction patch image with respect to the reference patch image rather than forming an image with the correction patch image shifted from the state (q1 state) in which the formation position of the reference patch image and that of the correction patch image are not in perfect register and are thus displaced from each other.

In this embodiment, the wider the region covered with the reference patch image or the correction patch image, the smaller the detection value of the registration detecting sensor 21. Therefore, as shown by the q1 state in FIG. 6 and FIG. 7, the detection value detected in the state in which a correction patch image is formed between reference patch images is smaller than the detection values detected in the states in which the correction patch image is formed over the reference patch image as shown by the q2 to q9 states in FIG. 6 and FIG. 7. In other words, the detection value becomes a minimum when the reference patch image and the correction patch image are formed without overlapping.

Figure 8:
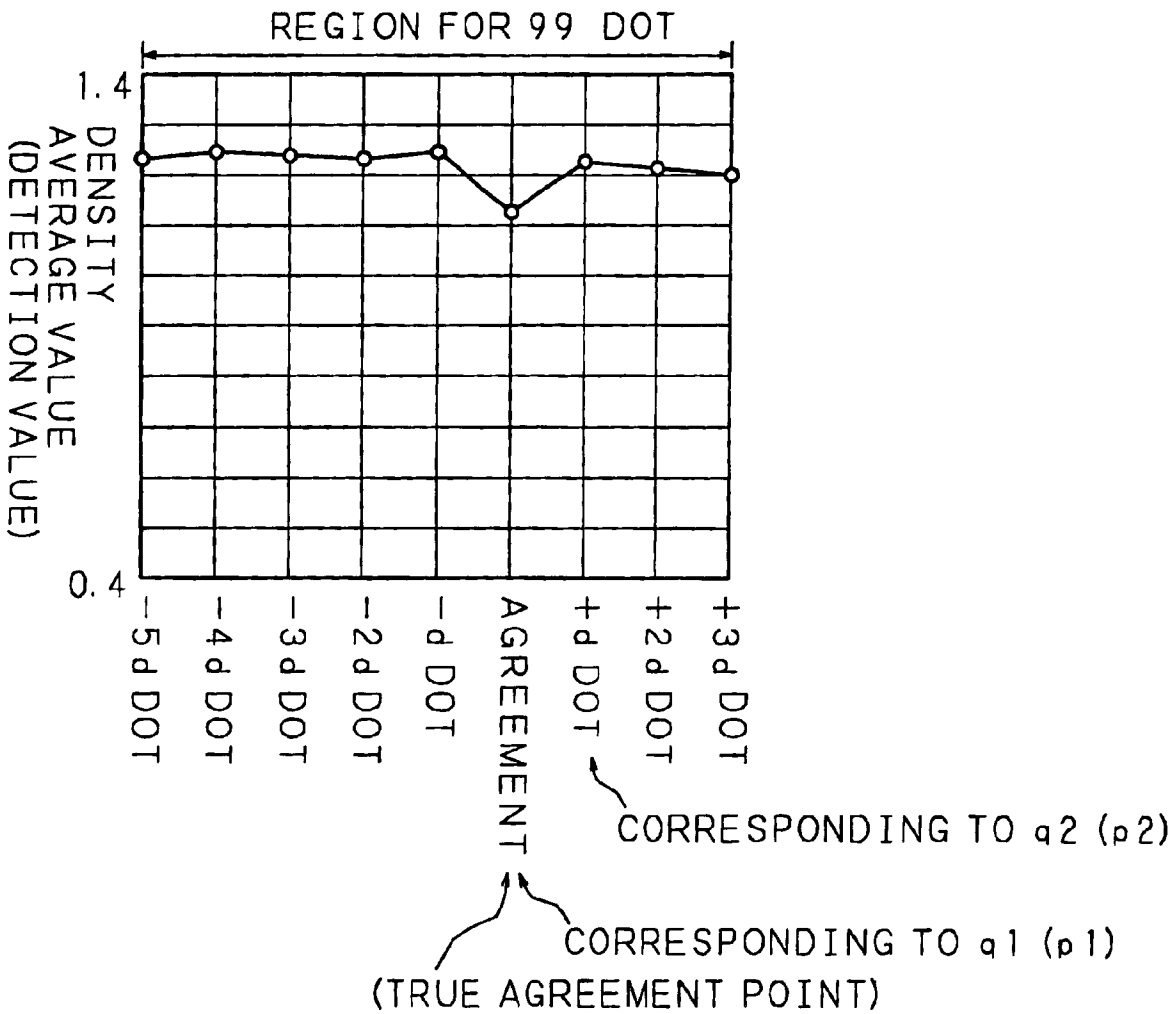
FIG. 8 is a graph showing the density average value of a region including the reference lines and correction lines within the sensor read area of the registration detecting sensor, for each superimposed state of the reference line and the correction line.

FIG. 8 is a graph showing the density average value in the region including the reference line and the correction line within the sensor read area of the registration detecting sensor 21, for each superimposed state of the reference line and the correction line.

Here, as shown in FIG. 8, in the state in which the reference patch image and the correction patch image are formed without overlapping (true agreement point in FIG. 8), the detection value becomes a minimum. Specifically, the density average value (detection value) at the 62nd dot adjustment position corresponding to the true agreement point is smaller than the density average values at the 7th dot adjustment position corresponding to the −5 dot misregistration state, the 18th dot adjustment position corresponding to the −4 dot misregistration state, the 29th dot adjustment position corresponding to the −3 dot misregistration state, the 40th dot adjustment position corresponding to the −2 dot misregistration state, the 51st dot adjustment position corresponding to the −d dot misregistration state, the 73rd dot adjustment position corresponding to the +d dot misregistration state, the 84th dot adjustment position corresponding to the +2d dot misregistration state, and the 95th dot adjustment position corresponding to the +3d dot misregistration state.

Therefore, if the exposure timing of the light exposure unit 1 to be subjected to adjustment is adjusted so that the detection value of the registration detecting sensor 21 becomes a minimum, it is possible to make a reference color component image and a color component image to be subjected to adjustment are in perfect register without a displacement. Consequently, it is possible to form a multicolor image without color misregistration.

Thus, in the second color superimposition adjustment, the density average value is also found by the registration detecting sensor 21 for each superimposed state of the reference patch image and the correction patch image. Further, by using the fact that the detection value becomes a minimum in the state in which the formation position of the reference patch image and that of the correction patch image do not overlap, the exposure timing of the light exposure unit 1 is adjusted so that the detection value of the registration detecting sensor 21 becomes a minimum, and thereby performing color superimposition adjustment.

As described above, by performing the color superimposition adjustment in two steps, namely, the first color superimposition adjustment and the second color superimposition adjustment, it is possible to determine an exposure timing of the light exposure unit 1 for forming a color component image to be subjected to adjustment, which enables the reference color component image and the color component image to be subjected to adjustment to be in perfect register with each other in a wide color superimposition adjustment range.

Moreover, in the second color superimposition adjustment, based on the result obtained by the first color superimposition adjustment, a reference patch image and a correction patch image having line patterns different from those in the first color superimposition adjustment are formed, and a state in which the reference patch image and the correction patch image do not perfectly overlap is found. Therefore, after finding one temporary agreement point from a narrow color superimposition adjustment range (a range of 11 dots) by the first color superimposition adjustment, a plurality of different temporary agreement points (8 points) which are the candidates of the true agreement point are further calculated, and then the true agreement point (1 point) is found from these temporary agreement points (9 points). Note that the color superimposition adjustment range at this time is a wide range (a range of 99 dots).

As described above, in this embodiment, by forming a reference patch image and a correction patch image whose formation position with respect to this reference patch image is shifted in 20 different patterns and then measuring the densities of the resulting images, it is possible to perform color registration adjustment in a wide range of 99 dots. Accordingly, it is possible to efficiently and easily perform color superimposition adjustment in a wide range, thereby enabling highly accurate color superimposition adjustment. These color superimposition adjustments are performed for each of the image stations corresponding to color components subjected to be to adjustment. However, only an explanation for one color component is written here. Specifically, in actual color superimposition adjustment, color registration adjustment is performed for each of cyan (C), magenta (M) and yellow (Y) with respect to black (K).

In the above explanation, only an explanation is made for the case where the color superimposition adjustment in sub-scanning direction is performed for the reference patch image and correction patch image formed on the transfer belt 7. However, there is a possibility that color misregistration occurs in the main scanning direction. In this case, color superimposition adjustment is performed by forming the reference patch image and the correction patch image in the main scanning direction in the same manner as in the color superimposition adjustment in sub-scanning direction.

Figure 9:
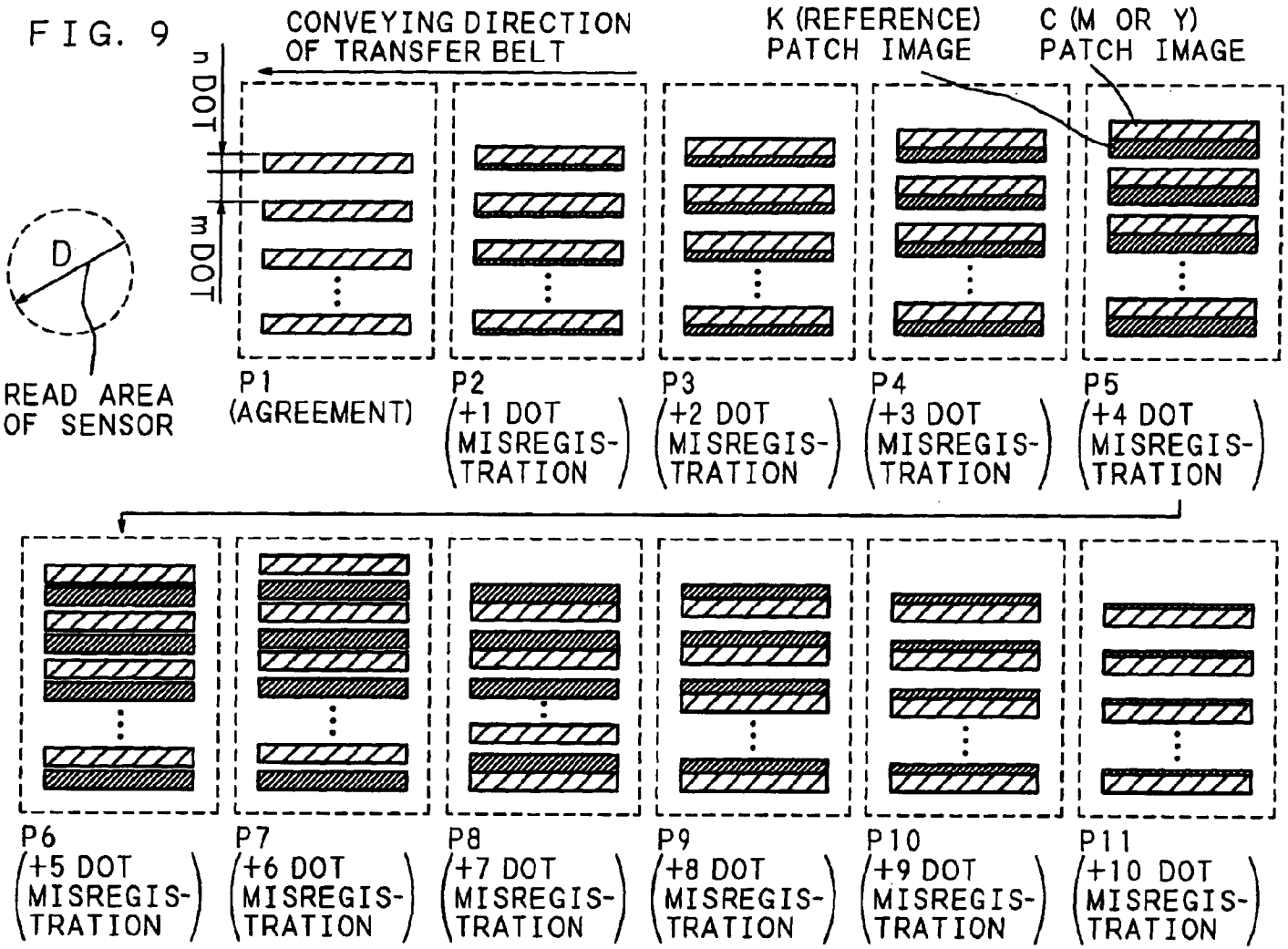
FIG. 9 is an explanatory view showing combined images formed by shifting the correction lines with respect to the reference lines at a rate of 1 dot in a main-scanning direction.
Figure 10:
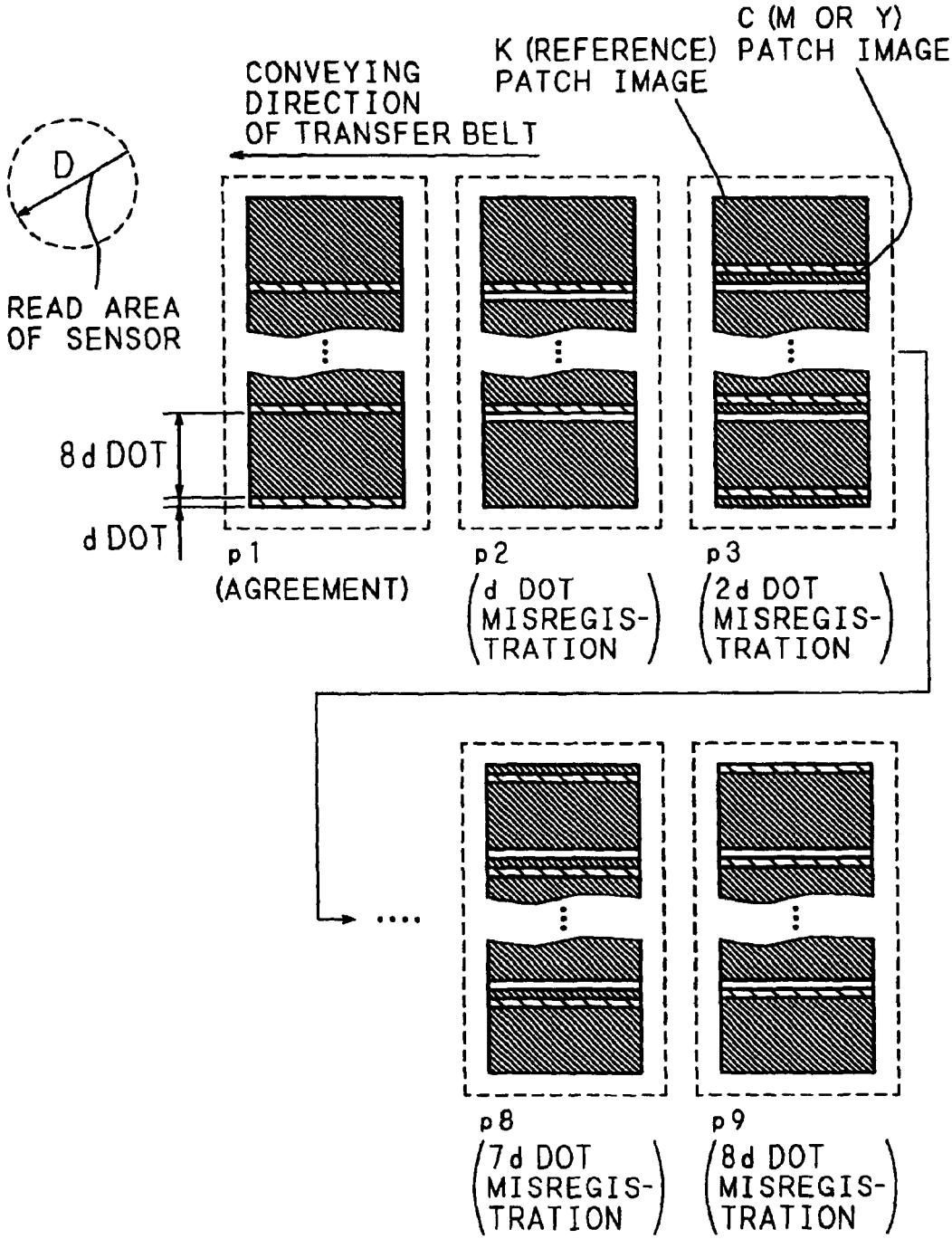
FIG. 10 is an explanatory view showing combined images formed by shifting the correction lines with respect to the reference lines at a rate of d dots (11 dots) in the main-scanning direction.

FIG. 9 is an explanatory view showing combined images formed by shifting the correction lines with respect to the reference lines at a rate of 1 dot in the main-scanning direction. FIG. 10 is an explanatory view showing combined images formed by shifting the correction lines with respect to the reference lines at a rate of d dots (11 dots) in the main-scanning direction.

In the color superimposition adjustment in main scanning direction, as shown in FIG. 9, first, as the first color superimposition adjustment, the correction line is formed while shifting it 1 dot by 1 dot within a range of the pitch of the reference line and the correction line (within n+m dots), and a state in which the reference patch image and the correction patch image perfectly overlap is found. Next, as the second color superimposition adjustment, as shown in FIG. 10, the correction line is shifted d dots by d dots (d=m+n), and a state in which the formation position of the reference patch image and that of the correction patch image do not overlap is found. By performing such color superimposition adjustments, an exposure timing that makes a reference color component image and a color component image to be subjected to adjustment in the main scanning direction in perfect register, and then the color component image to be subjected to adjustment is formed at this exposure timing.

Note that the color superimposition adjustment may be performed in either or both of the main scanning direction and the sub-scanning direction. Accordingly, it is possible to correct both of color misregistration in the sub-scanning direction and that in the main scanning direction according to a need, thereby achieving excellent image quality.

Further, the patch images to be used are not necessarily limited to the line patterns described above, and color superimposition adjustment may be performed by forming lines parallel to the sub-scanning direction and lines parallel to the main scanning direction and using the resulting cross patterns of the reference patch image and the correction patch image.

Besides, in the first color superimposition adjustment, although the correction patch image is formed over the reference patch image while shifting the correction line 1 dot by 1 dot, the shift amount of the correction line is not limited to 1 dot. For example, the shift amount of the correction line can be 2 dots. However, the smaller the pitch of shift of the correction line, the more accurate the first color superimposition adjustment. Note that the same can also be said for a new first color super imposition adjustment which will be described later.

Figure 11:
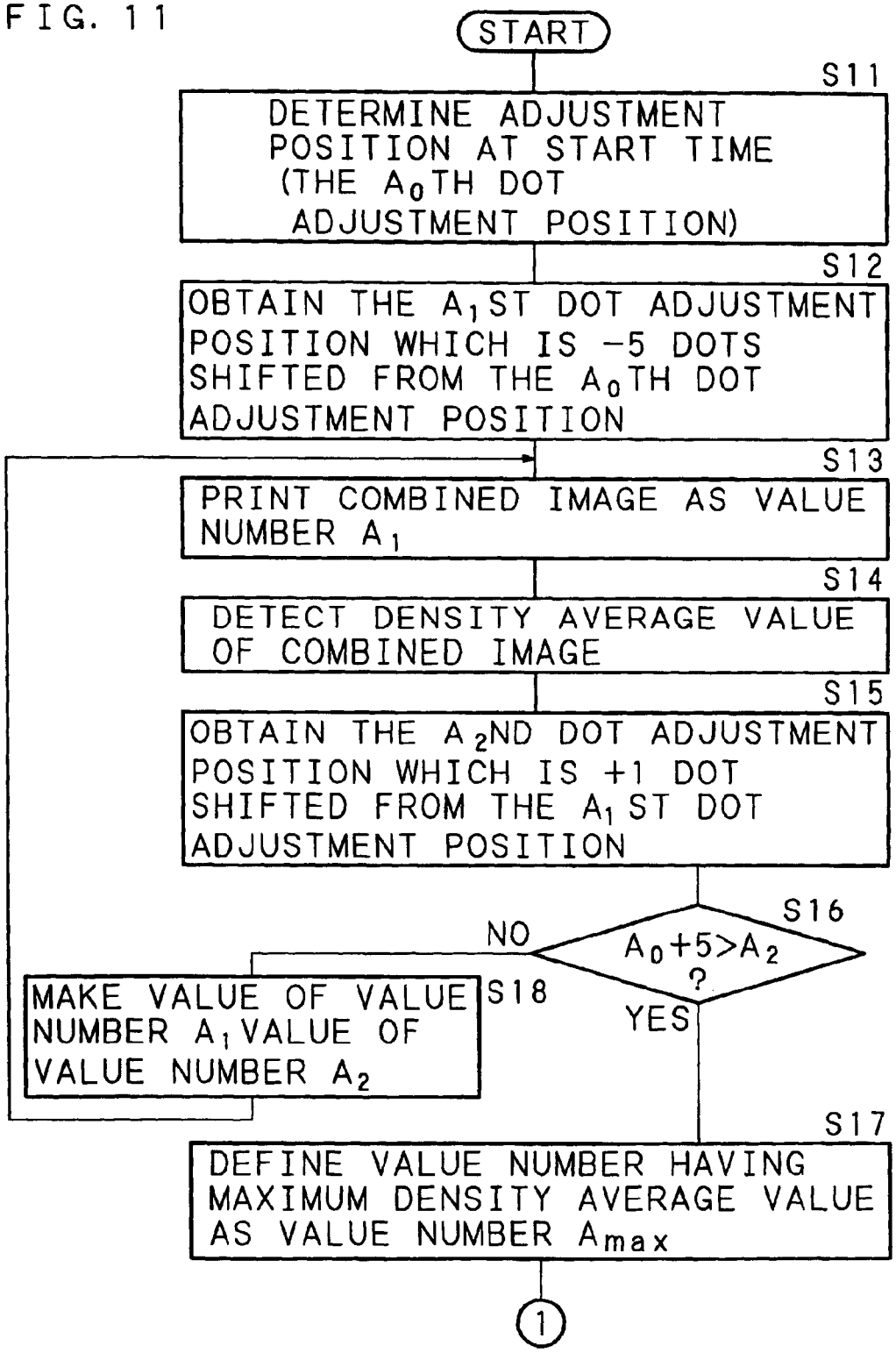
FIG. 11 is a flowchart showing the first color superimposition adjustment and the second color superimposition adjustment preformed in an image forming apparatus.
Figure 12:
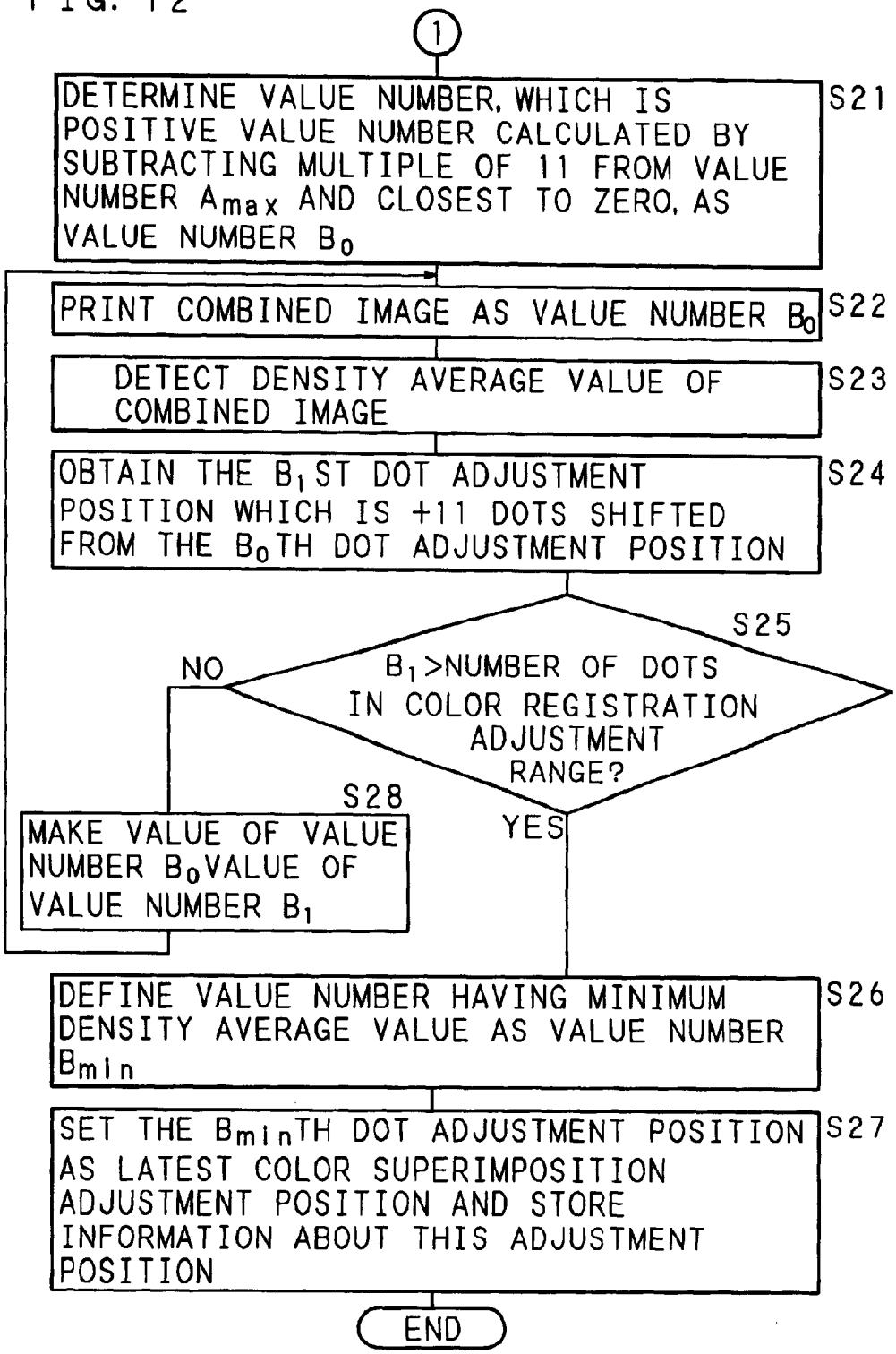
FIG. 12 is a flowchart showing the first color superimposition adjustment and the second color superimposition adjustment preformed in the image forming apparatus.

FIG. 11 and FIG. 12 are the flowchart showing the first color superimposition adjustment and the second color superimposition adjustment preformed in the image forming apparatus 100.

Similarly to the above explanation, this flowchart is illustrated by supposing that the color superimposition adjustment range is 99 dots, and the color registration adjustment range is from the 1st dot adjustment position to the 99th dot adjustment position. Moreover, in a combined image composed of a reference patch image and a correction patch image for use in the first color superimposition adjustment, the line pitch of each patch image is 11 dots, and both of the reference patch image and the correction patch image have a line width of 4 dots and a line spacing of 7 dots. Whereas, in a combined image for use in the second color superimposition adjustment, the line pitch of each patch image is 99 dots, the line width of the reference patch image is 88 dots, the line spacing of the reference patch image is 11 dots, the line width of the correction patch image is 11 dots, and the line spacing of the correction patch image is 88 dots.

The first color superimposition adjustment is represented by steps S11 to S17. Specifically, in S11, an arbitrary adjustment position of the correction patch image in the color superimposition adjustment range is determined as an adjustment position at start time (the $A_0$th dot adjustment position). Hereinafter, for the sake of explanation, in the expression "the nth dot adjustment position" for arbitrary n, the value of n will be referred to as the "value number". For example, the value number of the adjustment position at start time (the $A_0$th dot adjustment position) is $A_0$.

Here, suppose that the adjustment position at start time is a position to be the center of the color superimposition adjustment range. When the color superimposition adjustment range is 99 dots, the 50th dot adjustment position is set as the default position (the adjustment position at start time) in a storage section or the like of the image forming apparatus 100.

Next, in S12, the $A_1$th dot adjustment position (the 45th dot adjustment position) which is −5 dots shifted from the $A_0$th dot adjustment position (the 50th dot adjustment position) that is the adjustment position at start time is obtained. Next, in S13, a combined image composed of the reference patch image and the correction patch image formed at the $A_1$th dot adjustment position for use in the first color superimposition adjustment is printed on the transfer belt 7.

Then, after S13, the operation proceeds to S14. In S14, the registration detecting sensor 21 detects the density average value (SA) of a region including the reference patch image and the correction patch image on the transfer belt 7. Next, the operation proceeds to S15, and the $A_2$nd dot adjustment position (the 46th dot adjustment position) which is +1 dot shifted from the $A_1$th dot adjustment position (the 45th dot adjustment position) is obtained.

After S15, the operation proceeds to S16. In S16, a comparison is made to find whether or not the value of the value number ($A_0$+5) is larger than the value of the value number $A_2$. In S16, if the value of the value number ($A_0$+5) is smaller than the value of the value number $A_2$, the operation proceeds to S18. In S18, the value (45) of the value number $A_1$ is made the value (46) of the value number $A_2$. Namely, the value of the value number $A_1$ is made 46. After S18, the operation returns to S13, and repeats the above-mentioned sequence of processes again. On the other hand, in S16, if the value of the value number ($A_0$+5) is larger than the value of the value number $A_2$, the operation proceeds to S17.

As described above, in S11 to S16 and S18, the value number is changed from $A_0$ to $A_{10}$, combined images for use in the first color superimposition adjustment are respectively formed using the correction lines corresponding to the respective value numbers, and then the densities of the respective combined images are detected.

Next, in S17, among the detected SA values, a value number having the maximum SA value is defined as value number $A_{max}$. If the result of this first color superimposition adjustment is similar to the result shown in FIG. 5, the value number $A_{max}$ is 46 and the temporary agreement point is the 46th dot adjustment position.

The second color superimposition adjustment is represented by steps S21 to S27. In S21, a value number, which is a positive value number calculated by subtracting a multiple of 11 from the value number $A_{max}$ determined in S17 and closest to zero, is determined as value number $B_0$. Specifically, when the value number $A_{max}$ is 46, the value 2 obtained by subtracting 44 from the value number 46 is set as the value number $B_0$.

Next, in S22, a combined image composed of the reference patch image and the correction patch image formed at the $B_0$th dot adjustment position for use in the second color superimposition adjustment is printed on the transfer belt 7. After S22, the operation proceeds to S23. In S23, the registration detecting sensor 21 detects a density average value (SB) of a region including the reference patch image and the correction patch image on the transfer belt 7.

Next, in S24, the $B_1$st dot adjustment position (the 13th dot adjustment position) which is +11 dots shifted from the $B_0$th dot adjustment position (the 2nd dot adjustment position) is obtained. Specifically, the value number calculated by adding the pitch number 11 of the combined image used in the first color superimposition adjustment to the value number $B_0$ (2) is made the value number $B_1$ (13). After S24, the operation proceeds to S25.

In S25, the value number $B_1$ and the number of dots (99) in the color registration adjustment range are compared, and, if the value number $B_1$ is smaller, the operation proceeds to S28. In S28, the value (2) of the value number $B_0$ is made the value (13) of the value number $B_1$. Specifically, the value of the value number $B_0$ is made 13. After S28, the operation returns to S22 and repeats the above-mentioned sequence of processes again. On the other hand, in S25, if the value number $B_1$ is larger than the number of dots (99) in the color registration adjustment range, the operation proceeds to S26.

In S26, among the detection values SB detected in S23, a value number having the minimum SB value is defined as value number $B_{min}$. If the result obtained here is similar to the result shown in FIG. 8, the value number $B_{min}$ is 57, and the true agreement point is the 57th dot adjustment position.

Figure 13:
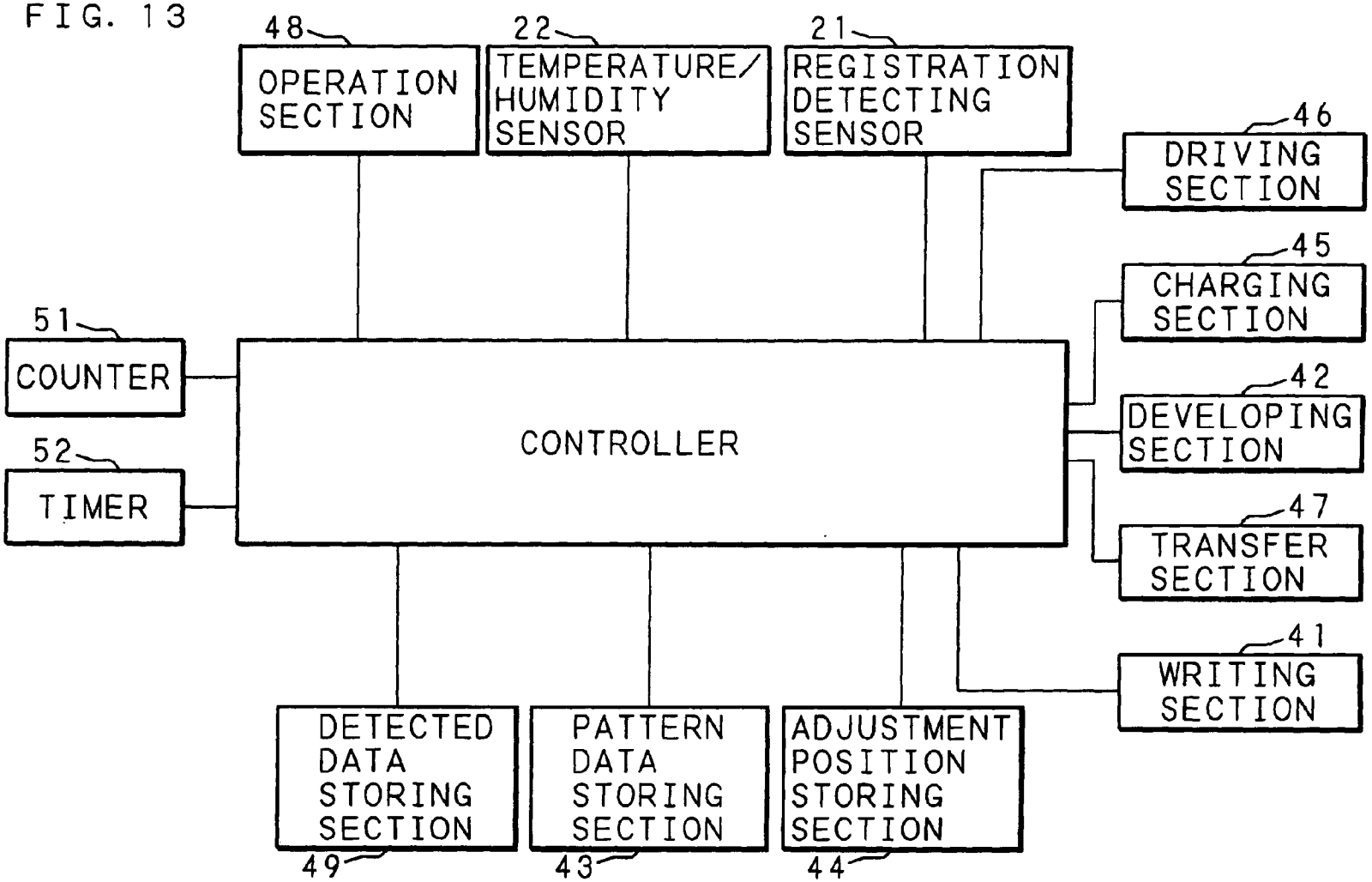
FIG. 13 is a block diagram showing the schematic configuration of a structure involved in color superimposition adjustment for correcting color misregistration of a multi-color image in the image forming apparatus.

Then, in S27, the $B_{min}$th dot adjustment position is set as the latest color superimposition adjustment position, and the information about this adjustment position is stored in an adjustment position storing section 44 (see FIG. 13). Based on this information, the exposure timing of the light exposure unit 1 of the image forming station 50 is adjusted. Similarly, the value number having the minimum SB value is calculated for the remaining colors to be subjected to correction, and the information about the adjustment positions of the respective colors are stored in the adjustment position storing section 44 (see FIG. 13).

FIG. 13 is a block diagram showing the schematic configuration of a structure involved in color superimposition adjustment for correcting color misregistration of a multicolor image in the image forming apparatus 100.

The structure involved in color superimposition adjustment comprises a controller 40, and a writing section 41, a transfer section 47, a developing section 42, a charging section 45, a driving section 46, a registration detecting sensor 21, a temperature/humidity sensor 22, an operation section 48, a counter 51, a timer 52, a detected data storing section 49, a pattern data storing section 43 and an adjustment position storing section 44 which are connected to the controller 40.

The controller 40 performs data processing, and outputs control signals to the respective sections. This controller 40 further comprises a size adjusting section (combined-image adjusting means), not shown, for setting a length in subscanning direction of a combined image. This size adjusting section will be described in detail later. Further, the step of performing size adjustment by this size adjusting section will be referred to as the combined image adjustment step.

In addition, although not shown in the drawing, the controller 40 comprises a position changing section (position changing means) for changing the adjustment position. Moreover, although not shown in the drawing, the controller 40 comprises a position determining section (position determining means) for determining a true agreement point from adjustment positions, based on the results of density average values of respective combined images.

The writing section 41 mainly refers to the light exposure unit 1, and forms an electrostatic latent image on the photosensitive drum 3. The transfer section 47 mainly refers to the transfer roller 6, and transfers a toner image onto the transfer belt 7 or a recording sheet. The developing section 42 mainly refers to the developing device 2, and develops the electrostatic latent image formed on the photosensitive drum 3 into a toner image. The charging section 45 mainly refers to the charging device 5, and charges the photosensitive drum 3. The driving section 46 is mainly a driving source and a transmission mechanism for transporting the recording sheet, and drives the sheet feed roller, transport roller, etc. The operation section 48 sets what control is to be performed. The counter 51 counts the number of times of execution of image formation. The timer 52 counts the total time of image formation executed from a certain time point. The detected data storing section 49 stores the information about temporary agreement points which became candidates of the true agreement point after the first color superimposition adjustment. The pattern data storing section 43 stores formation patterns when forming the reference patch image and the correction patch image. The adjustment position storing section 44 stores an adjustment position to be the true agreement point.

By the way, in the case where the image forming apparatus is assembled and then mounted in a place for actual use, the first color superimposition adjustment and the second color superimposition adjustment must be performed after replacement of a part, or after maintenance. Further, after the color superimposition adjustment, the information about an adjustment position to be the true agreement point is stored in the image forming apparatus, and image formation is performed based on this information.

After performing the above-mentioned color superimposition adjustment once, when performing color superimposition (registration) adjustment again before executing image formation, it is rarely the case that there is a large color misregistration. Therefore, when performing color superimposition adjustment again, the adjustment range in the second color registration adjustment may be narrowed, or the second color superimposition adjustment may be omitted.

It is also possible to arrange the color superimposition adjustment to be performed after elapse of a predetermined time from the supply of power, or after the number of times the image formation performed exceeds a predetermined number of sheets. In this case, it is often the case that there is almost no color misregistration, and therefore the time taken for color registration adjustment can be significantly shortened by omitting the second color registration adjustment.

In addition, even when the temperature/humidity sensor 22 installed inside the image forming apparatus senses that the temperature and humidity have reached a preset temperature and humidity, or senses abrupt changes in temperature and humidity, the color registration adjustment may be performed.

Further, if there is noticeable color misregistration after maintenance, such as replacement of processing units such as the photosensitive drum and developing unit, performed by a user or a service person, the user or the service person can force the image forming apparatus to perform color registration adjustment. In these cases, it is also possible to select whether the first color superimposition adjustment and the second color superimposition adjustment without narrowing the adjustment range are to be performed; the first color superimposition adjustment and the second color superimposition adjustment with a narrowed adjustment range are to be performed; or only the first color superimposition adjustment is to be performed.

Note that, when conditions for performing the color superimposition adjustment are met except for the color registration adjustment at the time of supply of power and the forced color registration adjustment, it is not necessary to perform the color registration adjustment immediately. For example, by performing the color registration adjustment after completion of the image forming job in progress but before starting the next image forming job, the image formation will not be interrupted, thereby improving conveniences.

By the way, there is a case that color misregistration can not be accurately corrected even when the above-mentioned color superimposition adjustment is performed. Specifically, even when the first color superimposition adjustment and the second color superimposition adjustment are performed, a phenomenon where the respective color components are not accurately superimposed is seen. Such a phenomenon is caused by the rotational irregularity of the photosensitive drum 3, or the rotational irregularity of the transfer belt driving roller 71.

The rotational irregularity of the photosensitive drum 3 and the rotational irregularity of the transfer belt driving roller 71 are mainly caused by the eccentricity of the photosensitive drum 3 and the eccentricity of the transfer belt driving roller 71, respectively. Note that, although the rotational irregularity of the photosensitive drum 3 is also caused by the eccentricity of the transmission member of a driving system for driving the photosensitive drum 3 or the rotational irregularity of the driving source of the driving system, this rotational irregularity is smaller compared to that caused by the eccentricity of the photosensitive drum 3. The same can also be said for the eccentricity of the transmission member of a driving system for driving the transfer belt driving roller 71, or the rotational irregularity of the driving source of the driving system.

Here, when rotational irregularity occurs due to the eccentricity of the photosensitive drum 3, the relative velocity between the peripheral velocity of the photosensitive drum 3 and the moving velocity of the transfer belt 7 varies at the contact portion where the photosensitive drum 3 and the transfer belt 7 come into contact with each other. Therefore, for a plurality of combined images formed by superimposing the reference patch image and the correction patch image at respectively different positions, even when the density average values of the respective combined images are compared to each other, if the regions of the respective photosensitive drums 3 where the respective color component images are formed differ randomly among the combined images, accurate comparison can not be made. Thus, accurate adjustment can not be performed.

Then, the following will discuss an image forming apparatus and a color superimposition adjustment method of an image forming apparatus, which can accurately correct color misregistration even when there is rotational irregularity in the photosensitive drum 3, or rotational irregularity in the transfer belt driving roller 71. Such an image forming apparatus and a color superimposition adjustment method will be explained with reference to FIG. 14 through FIG. 18.

In the first color superimposition adjustment, as described above, combined images are formed while shifting the correction lines at a rate of 1 dot with respect to the reference lines. Then, by detecting the densities of the respective combined images, a temporary agreement point is found. Thus, since the first color superimposition adjustment shifts the correction line one dot by one dot, it is susceptible to the influence of the rotational irregularity of the photosensitive drum 3. Therefore, there is a possibility that a temporary agreement point is wrongly detected.

Hence, based on the first color superimposition adjustment, by further forming combined images which take into account the circumference length of the photosensitive drum 3, an accurate temporary agreement point is found. First, the first color superimposition adjustment that takes into account the rotational irregularity of the photosensitive drum 3 (hereinafter referred to as the new first color superimposition adjustment) will be explained in Example 1 through Example 3 below.

In Example 1 through Example 3, the length in sub-scanning direction of each combined image is adjusted to a length substantially s times the circumference length of the photosensitive drum 3 (image carrier) by the size adjusting section (combined-image adjusting means). For the value of s, concrete examples are shown in the respective examples.

EXAMPLE 1

This example illustrates a case where the value of s is a positive integer.

This also illustrates a case where the length substantially s times the circumference length of the photosensitive drum 3 is a length calculated by adding a sub-scanning direction length of the detection surface of the registration detecting sensor 21 to a length s times the circumference length of the photosensitive drum 3.

Figure 14:
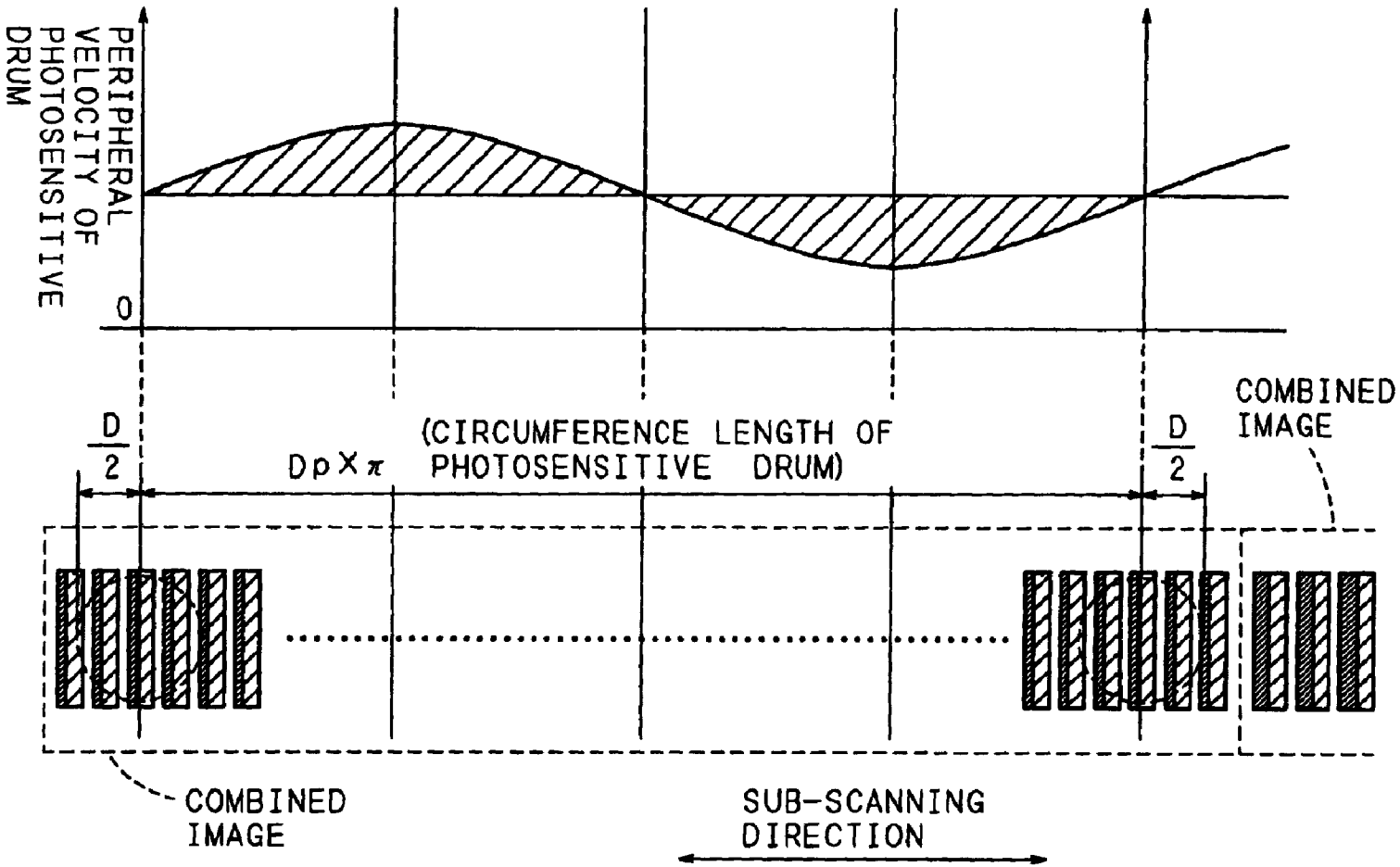
FIG. 14 is an explanatory view showing one example of color superimposition adjustment according to the present invention.

FIG. 14 is an explanatory view showing one example of this embodiment. More specifically, FIG. 14 is an explanatory view of the case where s is 1, i.e., the length in sub-scanning direction of a combined image is adjusted to a length calculated by adding the sub-scanning direction length of the detection surface of the registration detecting sensor 21 to the circumference length of the photosensitive drum 3. Further, FIG. 14 shows the state in which the correction line is shifted with respect to the reference line by a certain number of dots. Note that Dp is the diameter of the photosensitive drum 3, $Dp\times\pi$ is the circumference length of the photosensitive drum 3, and D is the sub-scanning direction length of the detection surface of the registration detecting sensor 21.

As described above, a combined image with s=1 (hereinafter referred to as the first combined image) is formed, and the density of this combined image is detected. In addition, by shifting the formation position of the correction patch image with respect to the reference patch image by +1 dot, a combined image (hereinafter referred to as the second combined image) is formed, and the density of this second combined image is detected. Subsequently, the same operation is repeated. For example, when each of the reference lines that form the reference patch image and the correction lines that forms the correction patch image has a line width n of 4 dots and a line spacing m of 7 dots, the eleventh combined image with the correction lines shifted by +10 dots from the correction lines of the first combined image is finally formed, and then the density of this combined image is detected.

Accordingly, for the respective combined images whose correction lines are shifted from each other by one dot, it is possible to detect the density average values of the respective combined images under the same conditions. Specifically, for each of the combined images, since the image with a length substantially equal to the circumference length of the photosensitive drum 3 is detected, even when there is rotational irregularity in the photosensitive drum 3, sampling is performed so that the rotational irregularity can be canceled, instead of uneven sampling. It is therefore possible to obtain a detection result similar to that obtained when there is no rotational irregularity. Thus, for a plurality of combined images formed by superimposing different color component images at respectively different positions, it is possible to perform an accurate comparison among the density average values of the respective combined images. Accordingly, an accurate temporary agreement point can be obtained without being influenced by the rotational irregularity of the photosensitive drum 3.

Next, the following description will explain specifically the number of reference lines and correction lines to be formed when s=1. Note that, when forming a combined image, as shown in FIG. 4, the shift amount of the correction line with respect to the reference line is defined as $\Delta L$, the distance from the leading position of the reference line to be formed first to the leading position of the reference line to be formed last is defined as L, and the line width of the reference line is defined as n. Moreover, the length in sub-scanning direction of each combined image is adjusted so that the registration detecting sensor 21 detects the densities of the respective combined images over a length calculated by adding the sub-scanning direction length (D) of the detection surface of the registration detecting sensor 21 to the circumference length ($Dp\times\pi$) of the photosensitive drum 3.

Therefore, the relationship shown by expression (1) below needs to be established among ΔL, L, n, Dp×π, and D.

$$Dp\times\pi+D<\Delta L+L+n \quad (1)$$

In expression (1), suppose that Dp is 30 mm, and D is 10 mm. When the resolution is 600 dpi, n is set to a length corresponding to 4 dots, i.e., a length given by equation (2) below. Note that the unit of n is mm.

$$n=4\times25.4/600 \quad (2)$$

Besides, since the minimum value of ΔL is obtained when the correction line shows no shift with respect to the reference line, ΔL=zero.

Accordingly, when Dp, D, n, and ΔL are substituted into expression (1), then L must satisfy the condition of expression (3) below.

$$L>104.0785 \quad (3)$$

Further, in the reference patch image and the correction patch image, the pitch (n+m) of each of the reference line and the correction line is a length corresponding to 11 dots, i.e., a length given by equation (4) below. Note that the unit of n+m is mm.

$$n+m=11\times25.4/600 \quad (4)$$

Here, when the value of the right side of expression (3) is divided by the value given by expression (4), then 223.5 is given. In this case, therefore, the reference patch images composed of at least 224 reference lines and the correction patch images composed of the same number of correction lines as the reference lines need to be formed.

Although the above example illustrates the case where s=1, s is not necessarily limited to this value. For example, even when s is a positive integer not less than 2, it is possible to find an accurate temporary agreement point without being influenced by the rotational irregularity of the photosensitive drum 3. However, when s is an integer not less than 2, since the amount of developer for forming the combined images composed of the reference patch images and correction patch images increases, it is preferable to form the combined images by setting s=1.

Besides, the above example illustrates the case where the length substantially s times the circumference length of the photosensitive drum 3 is a length calculated by adding the sub-scanning direction length of the detection surface of the registration detecting sensor 21 to the length s times the circumference length of the photosensitive drum 3. However, the present invention is not necessarily limited to this, and the length in sub-scanning direction of the combined image just needs to be a length substantially s times the circumference length of the photosensitive drum 3.

However, as illustrated in this example, when the length substantially s times the circumference length of the photosensitive drum 3 is made a length calculated by adding the sub-scanning direction length of the detection surface of the registration detecting sensor 21 to a length s times the circumference length of the photosensitive drum 3, it is possible to achieve further accurate color superimposition adjustment as to be described later. The reason for this effect will be explained below.

Since the measurement range (namely, the measured region during sampling) with the use of the detection surface of the registration detecting sensor 21 is usually a circular or oval shape, reflected light from a portion located at the center of the measurement range of the registration detecting sensor 21 and reflected light from a portion located at the edge of the measurement range differ from each other in the quantity of reflected light. Therefore, by adding the sub-scanning direction length of the detection surface that is the detection region length of the registration detecting sensor 21 to a length s times the circumference length of the photosensitive drum 3, a combined image of a length s times the circumference length of the photosensitive drum 3 can be detected at the center of the registration detecting sensor 21. It is therefore possible to perform further accurate color superimposition adjustment.

Moreover, in the image forming apparatus of this example, the combined images are formed separately for each photosensitive drum 3 (image carrier) with respect to the length related to the circumference length of the photosensitive drum 3. Further, it can be said that the image forming apparatus comprises combined-image adjusting means for forming a combined image so that the registration detecting sensor 21 (density detecting means) detects the density of the combined image at plural and substantially equal pitches within a range of at least one circumference length of the photosensitive drum 3 (image carrier). Note that the density is the density value obtained by one sampling.

EXAMPLE 2

This example illustrates a case where the value of s is a value expressed as 1/(2t) when t is a natural number not less than 2, and 9 same combined images are formed continuously so that the pitch of the same combined images is 1/t times the circumference length.

Similarly to Example 1 described above, this example illustrates the case where the sub-scanning direction length of the detection surface of the registration detecting sensor 21 is taken into consideration. However, the present invention is not necessarily limited to this.

Figure 15:
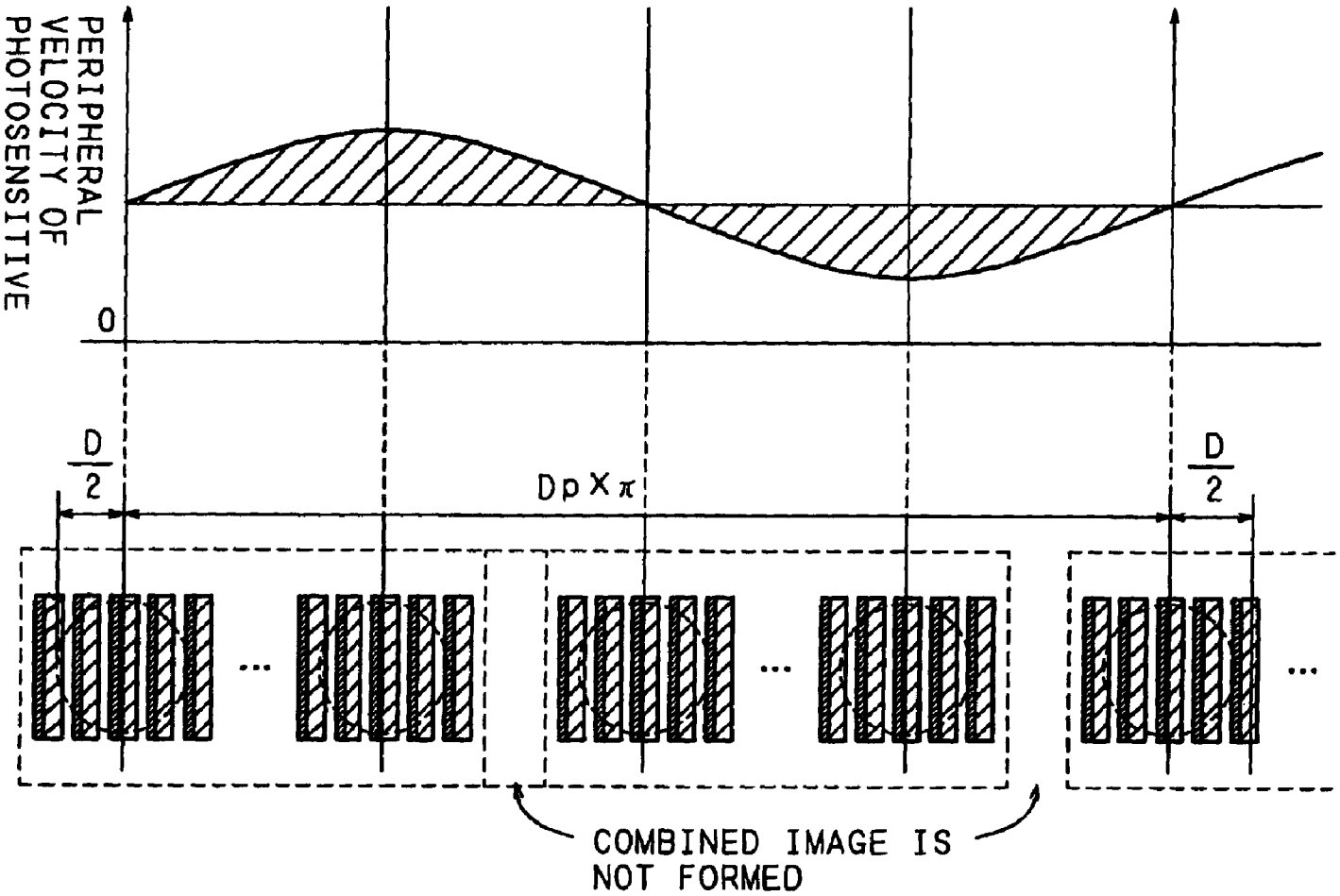
FIG. 15 is an explanatory view showing another example of color superimposition adjustment according to the present invention.

FIG. 15 is an explanatory view showing another example of this embodiment. More specifically, FIG. 15 is an explanatory view illustrating the case where the combined image is formed by setting t to 2, i.e., adjusting the length in sub-scanning direction of the combined image to a length calculated by adding the sub-scanning direction length of the detection surface of the registration detecting sensor 21 to a ¼ length of the circumference length of the photosensitive drum 3, and two same combined images are formed continuously at a pitch ½ times the circumference length. Similarly to FIG. 14, FIG. 15 shows a state in which the correction line is shifted with respect to the reference line by a certain number of dots.

Here, the circumference of the photosensitive drum 3*a* on which the reference patch image is to be formed is equally divided into 4 regions, and the 4 divided regions are sequentially named the 1a region, the 2a region, the 3a region, and the 4a region. Besides, the circumference of the photosensitive drum 3*b* on which the correction patch image is to be formed is equally divided into 4 regions, and the 4 divided regions are sequentially named the 1b region, the 2b region, the 3b region, and the 4b region. Here, a photosensitive drum on which the reference patch image is to be formed is the photosensitive drum 3*a* for black (K), and a photosensitive drum on which the correction patch image is to be formed is the photosensitive drum 3*b* for cyan (C), but the present invention is not necessarily limited to this.

Further, in FIG. 15, suppose that regions on the surface of the photosensitive drum 3*a* in which the same combined images are developed and which are the region corresponding to the circumference of the photosensitive drum 3*a*, excluding a portion corresponding to the sub-scanning direction length of the detection surface of the registration detecting sensor 21, are the 1a region and the 3a region. Besides, suppose that regions on the surface of the photosensitive drum 3*b* in which the same combined images are developed and which are the region corresponding to the circumference of the photosensitive drum 3*b*, excluding a portion corresponding to the sub-scanning direction length of the detection surface of the registration detecting sensor 21, are the 1b region and the 3b region. In addition, for the sake of explanation, suppose that one combined image is formed from the 1a region and the 1b region (hereinafter referred to as the first combined image), and the other combined image is formed mainly from the 3a region and the 3b region (hereinafter referred to as the second combined image).

Thus, by forming the two same combined images on the transfer belt 7 by mainly using the 1a region and 1*b* region and the 3a region and 3b region and further calculating the average of the respective density average values of the two same combined images, it is possible to cancel the influence of rotational irregularity even when there is rotational irregularity in the photosensitive drum 3. Specifically, when there is rotational irregularity, as described above, the relative velocity between the peripheral velocity of the photosensitive drum 3 and the moving velocity of the transfer belt 7 varies at the contact portion where the photosensitive drum 3 and the transfer belt 7 come into contact with each other. However, since the density detection is performed for the combined images formed by mainly using the regions (the 1a region and 3a region, and the 1b region and 3b region) equally distributed on the surface of the respective photosensitive drums 3*a* and 3*b*, it is possible to cancel the variations in the relative velocity. A more detailed explanation is given below.

The rotational irregularity of the photosensitive drum 3 has a cycle of one rotation of the photosensitive drum 3, and the peripheral velocity of this photosensitive drum 3 shows a velocity change as shown by the sine curve. This can be said for all of the photosensitive drums 3*a* to 3*d*.

For example, when one reference patch image is formed in a region with a high peripheral velocity, the other reference patch image of the pair is formed in a region with a low peripheral velocity. Regarding the correction patch images that form combined images (the first combined image or the second combined image) with the reference patch images, respectively, when one correction patch image is formed in a region with a high peripheral velocity, for example, the other correction patch image of the pair is formed in a region with a low peripheral velocity.

In this case, the first combined image and the second combined image have substantially different forms. Specifically, the first combined image is shrunk in the sub-scanning direction compared to that formed when there is no rotational irregularity in the photosensitive drum 3. On the other hand, the second combined image is expanded in the sub-scanning direction compared to that formed when there is no rotational irregularity in the photosensitive drum 3. Therefore, the density average value of the first combined image and that of the second combined image differ from each other.

Hence, for the first combined image and the second combined image, the density average values of the respective combined images are calculated, and then the average of the density average value of the first combined image and that of the second combined image is further calculated, so that a density average value similar to that obtained with a constant peripheral velocity is obtained. It is thus possible to cancel the rotational irregularity.

Note that, in the above explanation, for the sake of explanation, one reference patch image is formed in a region with a high peripheral velocity, the other reference patch image of the pair is formed in a region with a low peripheral velocity, one correction patch image is formed in the region with a high peripheral velocity, and the other correction patch image of the pair is formed in the region with a low peripheral velocity. However, this is merely an example, and, of course, the present invention is not limited to this.

Hence, it is possible to find an accurate temporary agreement point without being influenced by the rotational irregularity of the photosensitive drum 3. Moreover, when the combined images are formed in the above-mentioned manner, a region where the combined image is not formed appears at a pitch 1/t times the circumference length. It is therefore possible to reduce the amount of developer used for forming the combined images compared to the case where s=1.

Next, the following explanation will describe in detail the number of reference lines and correction lines to be formed when s=½ as described above.

In this case, the relationship shown by expression (5) below needs to be established among ΔL, L, n, Dp×π, and D.

$$(Dp\times\pi/4)+D<\Delta L+L+n \tag{5}$$

Moreover, like expression (1), suppose that Dp is 30 mm, and D is 10 mm. When the resolution is 600 dpi, n is set to a length corresponding to 4 dots, i.e., a length given by equation (2). Besides, since the minimum value of ΔL is obtained when the correction line shows no shift with respect to the reference line, ΔL=zero.

Accordingly, when Dp, D, n, and ΔL are substituted into expression (5), then L must satisfy the condition of expression (6) below.

$$L>33.3926 \tag{6}$$

Further, in the reference patch image and the correction patch image, the pitch (n+m) of each of the reference line and the correction line is a length corresponding to 11 dots, i.e., a length given by equation (4).

Here, when the value of the right side of expression (6) is divided by the value given by expression (4), then 71.7 is given. In this case, therefore, two combined images, each composed of a reference patch image composed of at least 72 reference lines and a correction patch image composed of the same number of correction lines as the reference lines, shall be formed.

Thus, compared to the case where s=1, there is no need to form 80 reference lines and 80 correction lines, 80 being the number given by subtracting 72×2 from 224.

Figure 16:
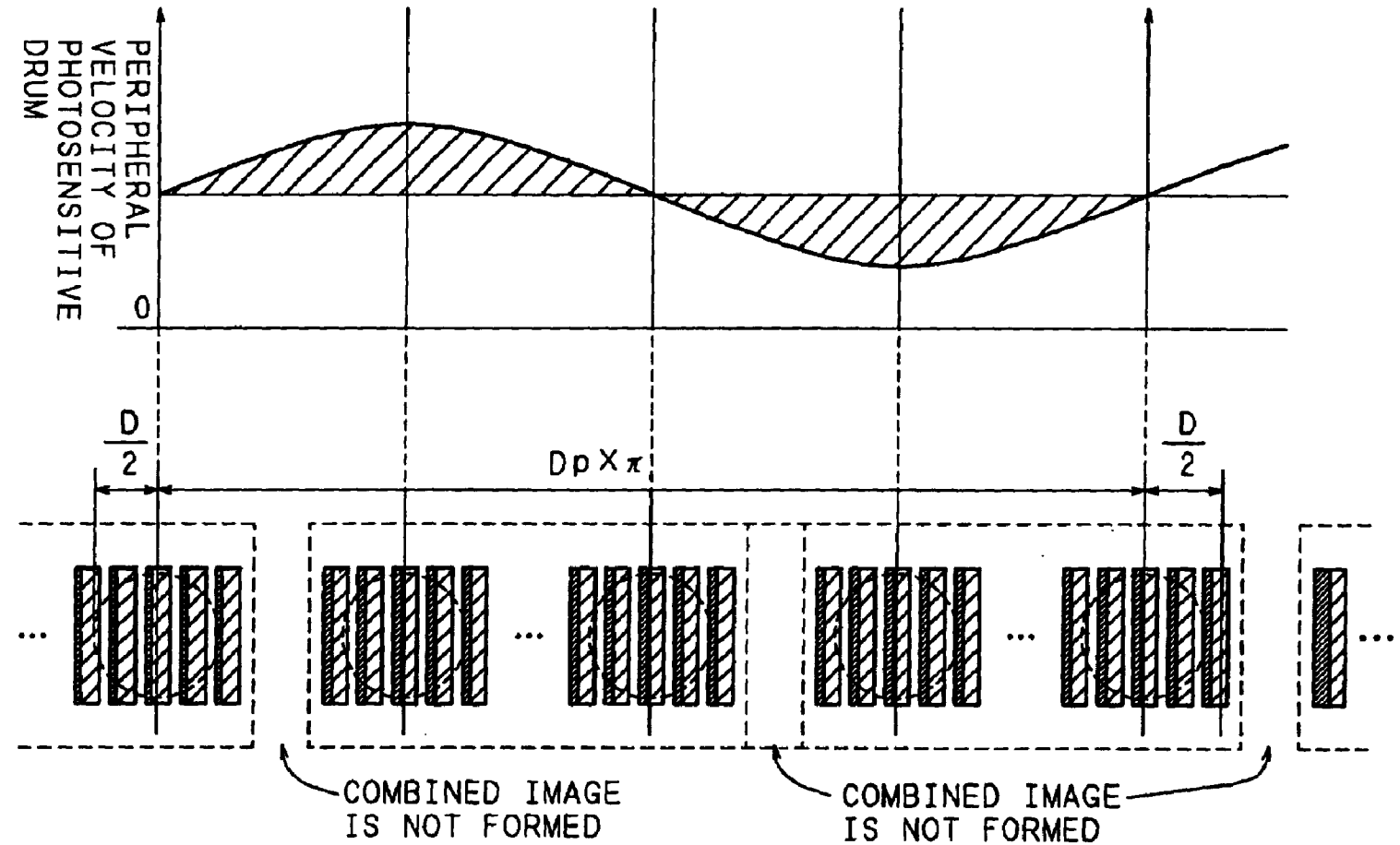
FIG. 16 is an explanatory view showing still another example of color superimposition adjustment according to the present invention.

FIG. 16 is an explanatory view showing still another example of this embodiment. More specifically, FIG. 16 is an explanatory view illustrating combined images formed by shifting the regions where the same combined images are formed by ¼ of the circumference length of the photosensitive drum 3 from FIG. 15.

In this case, one combined image is formed from the 2*a* region and the 2*b* region, and the other combined image is formed from the 4a region and the 4b region. Thus, by forming two same combined images on the transfer belt 7 by mainly using the 2a region and 2b region and the 4a region and 4b region of the photosensitive drum 3 and then detecting the densities of the two same combined images, it is possible to cancel the influence of the rotational irregularity of the photosensitive drum 3 in the same manner as above.

Note that, in the above explanation, although the explanation is given by supposing that t is 2, t is not necessarily limited to this. For example, when t is a constant k not less than 3, the circumference of the photosensitive drum 3*a* on which the reference patch image is to be formed is equally divided into 2k regions, and the 2k divided regions are named the 1a' region through the 2ka' region. In addition, the circumference of the photosensitive drum 3*b* on which the correction patch image is to be formed is equally divided into 2k regions, and the 2k divided regions are named the 1b' region through the 2kb' region.

Here, suppose that a region on the surface of the photosensitive drum 3*a* in which the same combined image is developed and which is the region corresponding to the circumference length of the photosensitive drum 3*a*, excluding a portion corresponding to the sub-scanning direction length of the detection surface of the registration detecting sensor 21, is the (2u−1)a' region. Here, u is a natural number not less than 1 but not more than k. Besides, suppose that a region on the surface of the photosensitive drum 3*b* in which the same combined image is developed and which is the region corresponding to the circumference of the photosensitive drum 3*b*, excluding a portion corresponding to the sub-scanning direction length of the detection surface of the registration detecting sensor 21, is the (2u−1)b' region. In addition, for the sake of explanation, suppose that one combined image (more precisely, a part of a combined image) is formed from the (2u−1)a' region and the (2u−1)b' region.

Thus, by forming k same combined images on the transfer belt 7 by mainly using the (2u−1)a' region and the (2u−1)b' region and further calculating the average of the respective density average values of the k same combined images, it is possible to cancel the influence of rotational irregularity even when there is rotational irregularity in the photosensitive drum 3.

However, if the value of t is increased too much, the control during the formation of the respective combined images and the control during the detection of the density average values of the respective combined images become complicated.

Further, in this example, the length in sub-scanning direction of the combined image is adjusted to a length calculated by adding the sub-scanning direction length of the detection surface of the registration detecting sensor 21 to a length 1/(2t) times the circumference length of the photosensitive drum 3. Therefore, in each combined image, in addition to the length 1/(2t) times the circumference length of the photosensitive drum 3, it is necessary to form an image of a length corresponding to at least the sub-scanning direction length of the detection surface of the registration detecting sensor 21. Thus, when the value of t is increased too much, the effect of reducing the developer by a region where the combined image is not formed can not be obtained.

Accordingly, it is particularly preferable to set the value of t to 2.

Besides, in the image forming apparatus 100 of this example, the combined images are formed separately for each photosensitive drum 3 (image carrier) with respect to the length related to the circumference length of the photosensitive drum 3. Furthermore, it can be said that the image forming apparatus 100 comprises combined-image adjusting means for forming a combined image so that the registration detecting sensor 21 (density detecting means) detects the density average value of the combined image at plural and substantially equal pitches within a range of at least one circumference length of the photosensitive drum 3 (image carrier).

Note that the density average value is the value obtained by sampling one combined image at a plurality of positions and averaging the sampling results.

EXAMPLE 3

In this example, when forming a new combined image by changing the superimposing position of the correction patch image, the new combined image is formed continuously, without an interval, after the previous combined image formed before changing of the superimposing position. Note that, like Example 2, this example illustrates the case where the sub-scanning direction length of the detection surface of the registration detecting sensor 21 is taken into consideration. However, the present invention is not necessarily limited to this.

Figure 17:
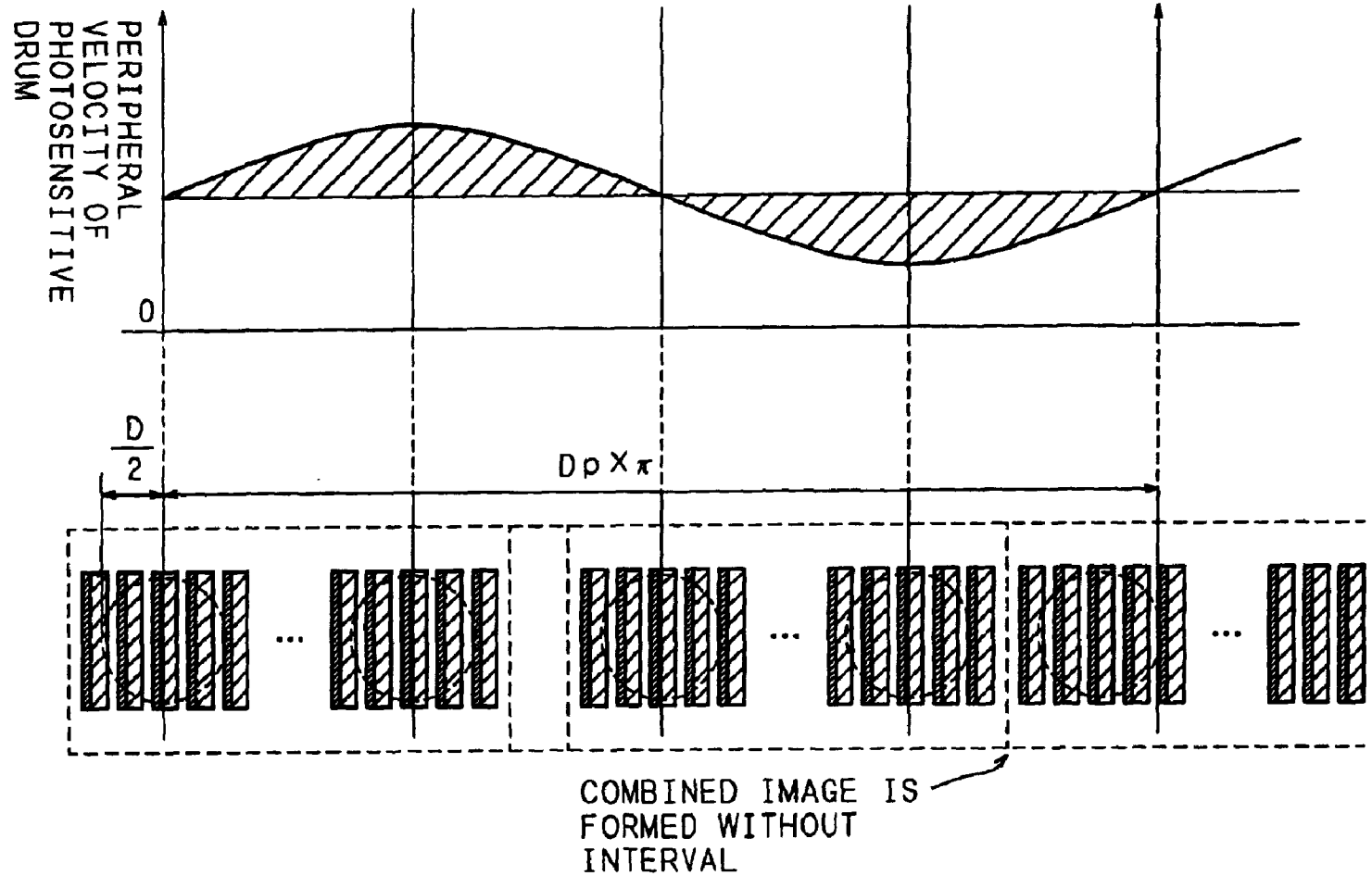
FIG. 17 is an explanatory view showing yet another example of color superimposition adjustment according to the present invention.

FIG. 17 is an explanatory view showing yet another example of this embodiment. More specifically, FIG. 17 is an explanatory view illustrating the case where the length in sub-scanning direction of the combined image is adjusted to a length calculated by adding the sub-scanning direction length of the detection surface of the registration detecting sensor 21 to a ¼ length of the circumference length of the photosensitive drum 3, two same combined images are formed continuously at a pitch ½ times the circumference length, and further a different combined image is formed continuously without an interval by shifting the correction patch image with respect to the reference patch image by a certain number of dots (for example, one dot). In this case, although not shown in the drawing, two different combined images are formed continuously at a pitch ½ times the circumference length.

Thus, when forming a combined image by further shifting the position of the correction patch image with respect to the reference patch image by a certain number of dots, a combined patch image formed immediately before shifting the correction patch image and a combined image formed immediately after shifting the correction patch image are always continuous. Therefore, compared to the case illustrated in Example 2 above (see FIG. 15 and FIG. 16), it is possible to reduce the number of regions where the combined image is not formed (hereinafter referred to as the no-image-formed region), which shall appear between respective combined images.

Specifically, the sum total of the sum of the region lengths in sub-scanning direction of all the combined images formed in this example and the sum of the lengths of the no-image-formed regions appeared in this example is smaller than that of Example 2. It is therefore possible to shorten the time taken for the new first color superimposition adjustment compared to Example 2 and improve the efficiency.

Accordingly, in this example, in addition to a reduction of the amount of developer used for forming the combined images, it is possible to shorten the time taken for color superimposition adjustment.

Note that, after completing formation of a combined image composed of a reference patch image and a correction patch image, when successively forming a new combined image including the reference patch image and different color component correction patch image, the new combined image may be formed continuously without an interval as described above.

Figure 18:
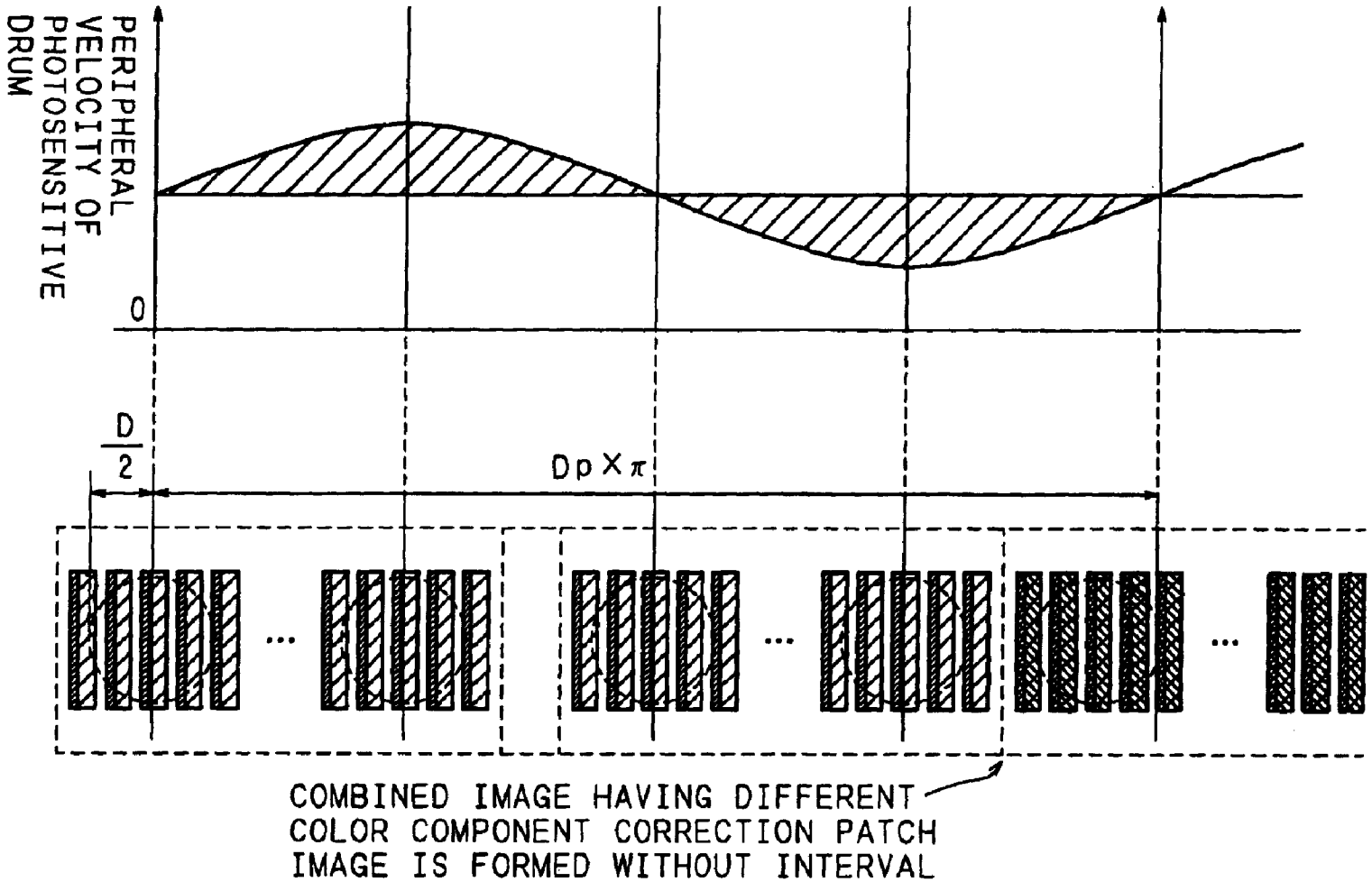
FIG. 18 is an explanatory view showing a further example of color superimposition adjustment according to the present invention.

FIG. 18 is an explanatory view showing a further example of this embodiment, and a state in which a combined image having the different color component correction patch image as described above is formed continuously without an interval.

In this case, it is also possible to reduce the amount of developer used for forming the combined images and further shorten the time taken for color superimposition adjustment.

FIG. 17 and FIG. 18 illustrate the case where t is 2, but t is not necessarily limited to this. Needless to say, even when t is a natural number not less than 3, similar effects can be obtained.

Moreover, in the image forming apparatus of this example, combined images are formed separately for each photosensitive drum 3 (image carrier) with respect to the length related to the circumference length of the photosensitive drum 3. Further, it can be said that the image forming apparatus comprises combined-image adjusting means for forming a combined image so that the registration detecting sensor 21 (density detecting means) detects the density average value of the combined image at plural and substantially equal pitches within a range of at least one circumference length of the photosensitive drum 3 (image carrier). Note that the density average value is a value obtained by sampling one combined image at a plurality of positions and averaging the sampling results.

By the way, Example 1 through Example 3 illustrate the means for calculating an accurate temporary agreement point without being influenced by the rotational irregularity of the photosensitive drum 3 by forming combined images which take into account the circumference length of the photosensitive drum 3. However, even when there is no rotational irregularity in the photosensitive drum 3, if there is rotational irregularity in the transfer belt driving roller 71 as described above, a phenomenon where the respective color components are not accurately superimposed will be seen.

Specifically, when rotational irregularity occurs due to the eccentricity of the transfer belt driving roller 71, etc., the moving velocity of the transfer belt 7 changes in a constant cycle according to this rotational irregularity, and the relative velocity between the peripheral velocity of the photosensitive drum 3 and the moving velocity of the transfer belt 7 changes at the contact potion where the photosensitive drum 3 and the transfer belt 7 come into contact with each other. Therefore, for a plurality of combined images formed by superimposing the reference patch images and the correction patch images at respectively different positions, even when the density average values of the respective combined images are compared to each other, if the change in the moving velocity of the transfer belt 7 at the contact potion differs randomly in each combined image formation, the comparison is not carried out accurately. Consequently, accurate adjustment can not be performed.

In such a case, the length in sub-scanning direction of each combined image needs to be adjusted to a length calculated by adding the sub-scanning direction length of the detection surface of the registration detecting sensor 21 (density detecting means) to a length s times the circumference length of the transfer belt driving roller 71 (transfer carrier driving means) by a size adjusting section (combined-image adjusting means).

Here, setting of the value of s and the technique of forming the combined images may be the same as those used in canceling the rotational irregularity of the photosensitive drum 3 of Example 1 through Example 3. Note that, in Example 1 through Example 3, the region of the surface of the photosensitive drum 3 is divided into four regions, for example, by taking into account the circumference length of the photosensitive drum 3, but, if the rotational irregularity of the transfer belt driving roller 71 is taken into consideration, the region of the surface of the transfer belt driving roller 71 shall be divided into four regions. Moreover, since the rotational irregularity of the photosensitive drum 3 is not taken into account, the image formation region on the photosensitive drum 3 is not particularly limited.

Further, in the case where there is rotational irregularity in both of the photosensitive drum 3 and the transfer belt driving roller 71, the length in sub-scanning direction of the combined image may be set by taking into account the rotational irregularity of the one which exerts a larger influence.

After completion of the new first color superimposition adjustment, it is necessary to perform the second color superimposition adjustment. However, in the second color superimposition adjustment, since combined images are formed by shifting the respective correction patch images one from another by the pitch of the reference line (for examples, n+m=11 dots) in the reference patch image, there is no need to take into account the rotational irregularity of the photosensitive drum 3, or the rotational irregularity of the transfer belt driving roller 71. Therefore, when forming each combined image, it is not necessary to form a combined image which takes into account the circumference length of the photosensitive drum 3, or a combined image which takes into account the circumference length of the transfer belt driving roller 71.

Moreover, in the color superimposition adjustment in main scanning direction, the rotational irregularity of the photosensitive drum 3 does not need to be taken into consideration. Therefore, when forming each combined image, it is not necessary to form a combined image which takes into account the circumference length of the photosensitive drum 3. Similarly, in the color superimposition adjustment in main scanning direction, the rotational irregularity of the transfer belt driving roller 71 does not need to be taken into consideration. Therefore, when forming each combined image, it is not necessary to form a combined image which takes into account the circumference length of the transfer belt driving roller 71. In short, in the color superimposition adjustment in main scanning direction, it is not necessarily to perform the new first color superimposition adjustment, and the first color superimposition adjustment will suffice.

Besides, in the above-described embodiment, the density average value is obtained by forming a combined image on the transfer belt 7, but the present invention is not necessarily limited to this. It is possible to use a recording sheet and form a combined image on the recording sheet instead of the transfer belt 7.

Further, in the above-described embodiment, the color super imposition adjustment that takes into account the rotational irregularity of the photosensitive drum 3 and/or the transfer belt driving roller 71 is explained as an example of application of color superimposition adjustment of the image forming apparatus using the first color superimposition adjustment and the second color superimposition adjustment. However, the color superimposition adjustment method that takes into account the rotational irregularity is not used only for the color superimposition adjustment of the image forming apparatus using the first color superimposition adjustment and the second color superimposition adjustment, and is applicable to a variety of uses.

As described above, in the present invention, each of a plurality of combined images is formed separately with respect to a length related to the circumference length of the image carrier or the transfer carrier driving means, and the present invention comprises the combined-image adjusting means for forming a combined image so that the density detecting means detects the density of the combined image at plural and substantially equal pitches within a range of at least one circumference length of the image carrier or the transfer carrier driving means, or so that the density detecting means detects the density average value of the combined image at plural and substantially equal pitches within a range of at least one circumference length of the image carrier or the transfer carrier driving means. Therefore, highly accurate color superimposition adjustment can be performed without being influenced by the rotational irregularity of the image carrier or the transfer carrier driving means.

Moreover, since the length in sub-scanning direction of the combined image formed by the combined-image adjusting means is set to a length substantially s times the circumference length of the image carrier or the transfer carrier driving means, it is possible to perform highly accurate color superimposition adjustment without being influenced by the rotational irregularity of the image carrier or the transfer carrier driving means.

Furthermore, since the length substantially s times the circumference length of the image carrier or the transfer carrier driving means is set to a length calculated by adding the sub-scanning direction length of the detection surface of the density detecting means to a length s times the circumference length of the image carrier or the transfer carrier driving means, it is possible to detect a combined image of a length s times the circumference of the image carrier or the transfer carrier driving means at the center of the density detection means. As a result, further accurate color superimposition adjustment can be performed.

Besides, since s is a positive integer, it is possible to perform highly accurate color superimposition adjustment without being influenced by the rotational irregularity of the image carrier, or the rotational irregularity of the transfer carrier driving means. Furthermore, by setting s to 1, it is possible to produce the effect of saving the developer for forming combined images compared to the case where s is not less than 2.

In addition, when t is a natural number not less than 2, since s is set to 1/(2t), t same combined images are continuously formed so that the pitch of the same combined images is 1/t times the circumference length, and a region where the combined image is not formed appears at a pitch 1/t times the circumference length of the image carrier or the transfer carrier driving means. It is therefore possible to further reduce the amount of developer used for forming the combined images.

Furthermore, since t is set to 2, it is possible to significantly reduce the amount of developer to be used. Besides, the control during the formation of each combined image and the control during the detection of the density average value of the combined image will not be complicated.

Additionally, different color component images are composed of a reference image of a color component whose superimposing position is fixed and a correction image of a color component to be subjected to superimposing position adjustment, and, in each of combined images formed by superimposing the different color component images at respectively different positions, the superimposing positions of the correction images with respect to the reference images are shifted from each other by a fixed distance. Therefore, even when performing precise color superimposition, it is possible to carry out accurate color superimposition adjustment.

Furthermore, when forming a new combined image by changing the superimposing position of the correction image, since the new combined image is formed continuously, without an interval, after the previous combined image formed before changing the superimposing position, it is possible to reduce the number of regions where the combined image is not formed, which appear between respective combined images. Accordingly, the time taken for the color superimposition adjustment can be shortened.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus comprising:

a plurality of image carriers on which images are formed based on image data;

a transfer carrier on which different color component images formed on said respective image carriers are superimposed sequentially with a movement of said transfer carrier in a sub-scanning direction;

a position changing section for changing a superimposing position of the different color component images;

a density detecting section for detecting a density average value of each combined image formed by superimposing the different color component images, for a plurality of combined images formed by superimposing the different color component images at respectively different positions; and a position determining section for determining a superimposing position of the different color component images, based on detection results of said density detecting section, wherein each of the plurality of combined images is formed separately for each image carrier with respect to a length related to a circumference length of the image carrier, and said image forming apparatus comprises a combined-image adjusting section for forming a combined image so that said density detecting section detects a density of the combined image at plural and substantially equal pitches within a range of at least one circumference length of said image carrier, or so that said density detecting section detects a density average value of the combined image at plural and substantially equal pitches within a range of at least one circumference length of said image carrier.

2. The image forming apparatus of claim 1, wherein a length in sub-scanning direction of the combined image formed by said combined-image adjusting section is a length substantially s times the circumference length of said image carrier.

3. The image forming apparatus of claim 2, wherein the length substantially s times the circumference length of said image carrier is a length calculated by adding a sub-scanning direction length of a detection surface of said density detecting section to a length s times the circumference length of said image carrier.

4. The image forming apparatus of claim 2, wherein said s is a positive integer.

5. The image forming apparatus of claim 2, wherein said s is expressed as 1/(2t) when t is a natural number not less than 2, and t same combined images are formed continuously so that a pitch of said same combined images is 1/t times the circumference length.

6. The image forming apparatus of claim 5, wherein said t is 2.

7. The image forming apparatus of claim 1, wherein the different color component images are composed of a reference image of a color component whose superimposing position is fixed and a correction image of a color component to be subjected to superimposing position adjustment, and in each of the combined images formed by superimposing the different color component images at respectively different positions, the superimposing positions of the correction images with respect to the reference images are shifted from each other by a fixed distance.

8. The image forming apparatus of claim 7, wherein when forming a new combined image by changing the superimposing position of the correction image, the new combined image is formed continuously, without an interval, after a previous combined image formed before changing the superimposing position.

9. An image forming apparatus comprising:

a plurality of image carriers on which images are formed based on image data;

a transfer carrier on which different color component images formed on said respective image carriers are superimposed sequentially with a movement of said transfer carrier in a sub-scanning direction;

a transfer carrier driving section for driving and rotating said transfer carrier;

a position changing section for changing a superimposing position of the different color component images;

a density detecting section for detecting a density average value of each combined image formed by superimposing the different color component images, for a plurality of combined images formed by superimposing the different color component images at respectively different positions; and a position determining section for determining a superimposing position of the different color component images, based on detection results of said density detecting section, wherein each of the plurality of combined images is formed separately with respect to a length related to a circumference length of said transfer carrier driving section, and said image forming apparatus comprises a combined-image adjusting section for forming a combined image so that said density detecting section detects a density of the combined image at plural and substantially equal pitches within a range of at least one circumference length of said transfer carrier driving section, or so that said density detecting section detects a density average value of the combined image at plural and substantially equal pitches within a range of at least one circumference length of said transfer carrier driving section.

10. The image forming apparatus of claim 9, wherein a length in sub-scanning direction of the combined image formed by said combined-image adjusting section is a length substantially s times the circumference length of said transfer carrier driving section.

11. The image forming apparatus of claim 10, wherein the length substantially s times the circumference length of said transfer carrier driving section is a length calculated by adding a sub-scanning direction length of a detection surface of said density detecting section to a length s times the circumference length of said transfer carrier driving section.

12. The image forming apparatus of claim 10, wherein said s is a positive integer.

13. The image forming apparatus of claim 10, wherein said s is expressed as 1/(2t) when t is a natural number not less than 2, and t same combined images are formed continuously so that a pitch of said same combined images is 1/t times the circumference length.

14. The image forming apparatus of claim 13, wherein said t is 2.

15. The image forming apparatus of claim 9, wherein the different color component images are composed of a reference image of a color component whose superimposing position is fixed and a correction image of a color component to be subjected to superimposing position adjustment, and in each of the combined images formed by superimposing the different color component images at respectively different positions, the superimposing positions of the correction images with respect to the reference images are shifted from each other by a fixed distance.

16. The image forming apparatus of claim 15, wherein when forming a new combined image by changing the superimposing position of the correction image, the new combined image is formed continuously, without an interval, after a previous combined image formed before changing the superimposing position.

17. A color superimposition adjustment method of an image forming apparatus, comprising the steps of:

forming images on a plurality of image carriers, based on image data;

sequentially superimposing different color component images formed on said respective image carriers, on a transfer carrier moving in a sub-scanning direction;

changing a superimposing position of the different color component images;

detecting a density average value of each combined image formed by superimposing the different color component images, in a density detection section, for a plurality of combined images formed by superimposing the different color component images at respectively different positions; and determining a superimposing position of the different color component images, based on detection results of said density detecting section, wherein each of the plurality of combined images is formed separately for each image carrier with respect to a length related to a circumference length of the image carrier, and said method comprises a combined-image adjusting step for forming a combined image so that said density detecting section detects a density of the combined image at plural and substantially equal pitches within a range of at least one circumference length of said image carrier, or so that said density detecting section detects a density average value of the combined image at plural and substantially equal pitches within a range of at least one circumference length of said image carrier.

18. The color superimposition adjustment method of an image forming apparatus of claim 17, wherein a length in sub-scanning direction of the combined image formed by the combined-image adjusting step is a length substantially s times the circumference length of said image carrier.

19. The color superimposition adjustment method of an image forming apparatus of claim 18, wherein the length substantially s times the circumference length of said image carrier is a length calculated by adding a sub-scanning direction length of a detection surface of said density detecting section to a length s times the circumference length of said image carrier.

20. A color superimposition adjustment method of an image forming apparatus, comprising the steps of:

forming images on a plurality of image carriers, based on image data;

sequentially superimposing different color component images formed on said respective image carriers, on a transfer carrier which is moving in a sub-scanning direction with a rotation of a transfer carrier driving section;

changing a superimposing position of the different color component images;

detecting a density average value of each combined image formed by superimposing the different color component images, in a density detection section, for a plurality of combined images formed by superimposing the different color component images at respectively different positions; and determining a superimposing position of the different color component images, based on detection results of said density detecting section, wherein each of the plurality of combined images is formed separately with respect to a length related to a circumference length of said transfer carrier driving section, and said method comprises a combined-image adjusting step for forming a combined image so that said density detecting section detects a density of the combined image at plural and substantially equal pitches within a range of at least one circumference length of said transfer carrier driving section, or so that said density detecting section detects a density average value of the combined image at plural and substantially equal pitches within a range of at least one circumference length of said transfer carrier driving section.

21. The color superimposition adjustment method of an image forming apparatus of claim 20, wherein a length in sub-scanning direction of the combined image formed by the combined-image adjusting step is a length substantially s times the circumference length of said transfer carrier driving section.

22. The color superimposition adjustment method of an image forming apparatus of claim 21, wherein the length substantially s times the circumference length of said transfer carrier driving section is a length calculated by adding a sub-scanning direction length of a detection surface of said density detecting section to a length s times the circumference length of said transfer carrier driving section.

* * * * *